US007330671B2

(12) United States Patent
Takahashi

(10) Patent No.: US 7,330,671 B2
(45) Date of Patent: Feb. 12, 2008

(54) IMAGE FORMING DEVICE INCLUDING DISCRIMINATING UNIT AND ATTACHED WITH REPLACEMENT UNIT

(75) Inventor: Atsushi Takahashi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/068,786

(22) Filed: Mar. 2, 2005

(65) Prior Publication Data

US 2005/0254838 A1 Nov. 17, 2005

(30) Foreign Application Priority Data

May 17, 2004 (JP) ..... 2004-146150
May 17, 2004 (JP) ..... 2004-146153

(51) Int. Cl.
*G03G 15/00* (2006.01)

(52) U.S. Cl. ..... 399/12

(58) Field of Classification Search ..... 399/12, 399/24, 27, 13

See application file for complete search history.

(56) References Cited

U.S. PATENT DOCUMENTS 4,955,299 A * 9/1990 Ohta ..... 101/143
5,289,210 A * 2/1994 Takayanagi ..... 347/14
RE35,751 E * 3/1998 Midgley ..... 399/25
5,828,389 A * 10/1998 Yamaguchi et al. ..... 347/23
6,212,338 B1 * 4/2001 Hagihara et al. ..... 399/12
6,311,025 B1 * 10/2001 Nagata et al. ..... 399/12
6,672,695 B1 * 1/2004 Naka et al. ..... 347/7
6,979,139 B2 * 12/2005 Hine et al. ..... 400/76
2005/0078969 A1 * 4/2005 Kikuchi ..... 399/12
2006/0051106 A1 * 3/2006 Takahashi et al. ..... 399/12

FOREIGN PATENT DOCUMENTS

JP A 06-149051 5/1994
JP B2 2602341 1/1997
JP A 10-133528 5/1998
JP 11126391 A * 5/1999
JP A 2000-284581 10/2000
JP 2001071469 A * 3/2001
JP A-2001-71469 3/2001
JP A 2001-100598 4/2001
JP B2 3476704 9/2003
KR 2001-0049000 6/2001

* cited by examiner

*Primary Examiner*—Quana Grainger
(74) *Attorney, Agent, or Firm*—Oliff & Berridge PLC

(57) ABSTRACT

Respective operation mode histories are stored in the main body NVM of an image forming device. The main body NVM stores an operation mode just before the turning-off of the power supply. When the power supply of the image forming device is turned on, a CPU discriminates whether a replacement unit having been attached is a genuine type or one other than the genuine type. When an operation mode just before the turning-off of the power supply differs from an operation mode corresponding to the replacement unit having been attached, such a fact is displayed on a UI device. When a user confirms the display on the UI device, the image forming device is controlled by the operation mode corresponding to the replacement unit.

11 Claims, 30 Drawing Sheets

(FIG. 18 CONTINUED)
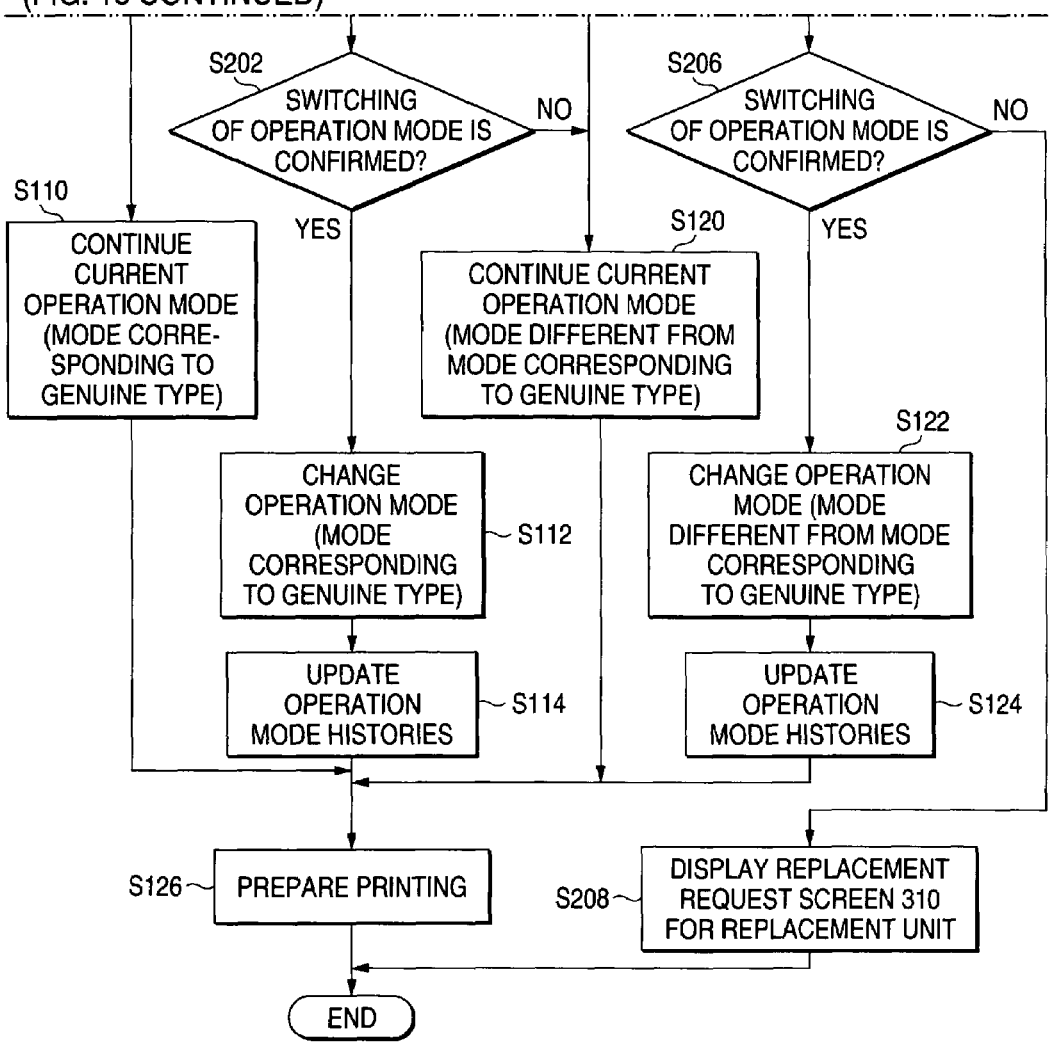

IMAGE FORMING DEVICE INCLUDING DISCRIMINATING UNIT AND ATTACHED WITH REPLACEMENT UNIT

BACKGROUND OF THE INVENTION

1. Field of the Invention

The present invention relates to an image forming device and, more in detail, relates to an image forming device in which a replacement unit is attached to a device main body in an exchangeable manner.

2. Background Art

An image forming device is known which is arranged to be able to easily exchange a unit containing expendable material etc. by a user.

On the other hand, when a unit exchanged by a user is a unit other than a genuine type for an image forming device, there may arise such a problem that the efficiency of the image forming device can not be exerted sufficiently such that image quality is degraded, the operation of the device can not be guaranteed or a failure occurs. This is because the image forming device controls the image forming process in view of the characteristics of toner, the characteristics of image carrier, the charging voltage, the cleaning characteristics, the fixing characteristics etc.

Thus, in order to maintain the image quality and prevent the occurrence of the problems in the image forming device, JP-A-10-133528 discloses a method that a replacement part of a genuine type is provided with a data carrier for holding used amount data of expendable material, and a used amount detected by a used amount detection unit provided within a device main body is compared with used amount data held by the data carrier thereby to determine whether or not the expendable material is supplied to the replacement part of the genuine type.

Further, JP-A-6-149051 discloses that a toner cartridge is provided with a storage unit for storing predetermined code data, and a copying operation is inhibited when a duplicator main body side can not read the predetermined code data from the storage unit.

Further, JP-A-2001-100598 discloses a method that in a case where shortage of toner is detected, when empty information written in a cartridge is read from the cartridge in which toner is supplemented, an alarm is displayed and a printing operation is inhibited.

Further, Japanese Patent No. 2602341 discloses a method that the count of images having been formed is stored in the memory of a cartridge, and the cartridge is made to be unusable hereinafter when a preset end count representing an image number capable of forming by the cartridge is equal to the count of images having been formed.

Furthermore, Japanese Patent No. 3476704 discloses a method that when a supplementary toner bottle having been attached is determined to be incompatible and the continuation of the supplemental processing is selected by a selection input unit by ignoring this determination through a bi-directional communication between the container end communication unit of the supplementary toner bottle and the main body end communication unit of a device main body, an image forming condition which is lowered in its level than the suitable image forming condition is set thereby to make it facilitate to find that the supplementary toner bottle is incompatible.

SUMMARY OF THE INVENTION

A first object of the invention is to provide an image forming device and an image forming system each of which can use a replacement unit other than a genuine type unit according to the intension of a user even when the replacement unit other than the genuine type unit is attached. A second object of the invention is to provide an image forming device and an image forming system each of which can, even when a replacement unit is attached in a state where the power source of a device main body is turned off, perform the control in correspondence to the attached replacement unit when the power source is turned on. A third object of the invention is to provide an image forming device which can use a replacement unit other than a genuine type even when it is not detected that a replacement unit has been replaced.

In order to attain the aforesaid object, according to a first aspect of the invention, there is provided an image forming device including: a device main body; at least one replacement unit attached to the device main body in an exchangeable manner; a discriminating unit for discriminating at a time of turning-on of a power supply whether the replacement unit is a genuine type or one other than the genuine type; a storage unit for storing a status of the replacement unit upon turning-off of the power supply as to whether the replacement unit is the genuine type or one other than the genuine type; and a comparison unit for comparing storage content of the storage unit with discrimination result of the discriminating unit. Accordingly, even when a replacement unit is attached in a state where the power supply of the device main body is turned off, it can be detected at the time of the turning-on of the power supply of the device main body as to whether or not the replacement unit having been attached is a replacement unit attached before the turning-off of the power supply of the device main body.

Preferably, the image forming device further includes a display unit for displaying the status of the replacement unit according to comparison result of the comparison unit. Thus, a user can recognize information concerning a replacement unit having been attached in the turning-off state of the power supply.

Further, preferably, the image forming device further includes a control unit for performing a control in accordance with an operation mode according to the comparison result of the comparison unit. Thus, when the power supply of the device main body is turned on, the control can be performed in accordance with the operation mode corresponding to a replacement unit having been attached even when the replacement unit is attached in the turning-off state of the power supply of the device main body.

In this case, the operation mode unit the control mode of the image forming device which includes not only a program and a control parameter for forming an image but also an input condition and an output condition and further includes a display mode for a display device not directly related to the image forming.

According to a second aspect of the invention, there is provided an image forming device including: a device main body; at least one replacement unit attached to the device main body in an exchangeable manner; a discriminating unit for discriminating at a time of turning-on of a power supply whether the replacement unit is a genuine type or one other than the genuine type; an input unit for selecting a first operation mode corresponding to the replacement unit of the genuine type and another operation mode different from the first operation mode; a storage unit for storing a status of the replacement unit upon turning-off of the power supply as to whether the replacement unit is the genuine type or one other than the genuine type; a comparison unit for comparing storage content of the storage unit with discrimination result of the discriminating unit; and a control unit for performing a control in accordance with the operation mode selected by the input unit. Accordingly, even when a replacement unit is attached in a state where the power supply of the device main body is turned off, the control can be performed with the operation mode selected by a user at the time of the turning-on of the power supply. Thus, a user can use a replacement unit other than a genuine type by the intent of the user.

Preferably, the image forming device further includes a display unit for displaying the status of the replacement unit according to comparison result of the comparison unit. Thus, a user can recognize information concerning a replacement unit having been attached in the turning-off state of the power supply.

In order to attain the aforesaid object, according to a third aspect of the invention there is provided an image forming device including: a device main body; at least one replacement unit attached to the device main body in an exchangeable manner; a reading unit for reading information relating to the replacement unit from the replacement unit; a discriminating unit for discriminating whether the replacement unit is a genuine type or one other than the genuine type in accordance with the information read from the reading unit; an input unit for selecting one operation mode corresponding to the replacement unit of the genuine type or another operation mode different from the one operation mode; and a control unit for controlling in accordance with the operation mode selected by the input unit.

That is, since the reading unit reads the information relating to the replacement unit from the replacement unit, a user can select one operation mode corresponding to the replacement unit of the genuine type or another operation mode different from the one operation mode, so that a replacement unit other than the genuine type can be used according to the intension of a user.

In this respect, the operation mode unit a control mode of the image forming device, and includes not only a program and a control parameter for forming images but also an input condition and an output condition and further includes a display mode for a display device not directly related to the image forming.

Preferably, the reading unit reads the information relating to the replacement unit in accordance with at least one of a predetermined time period and a predetermined time. Thus, even when it is not detected that a replacement unit has been exchanged, since the reading unit reads the information relating to the replacement unit from the replacement unit, a user can select one operation mode corresponding to the replacement unit of the genuine type or another operation mode. Thus, a replacement unit other than the genuine type can be used according to the intension of a user.

Further, preferably, the reading unit includes a setting unit for setting at least one of the predetermined time period and the predetermined time each for reading the information relating to the replacement unit, and the reading unit reads the information relating to the replacement unit in accordance with at least one of the predetermined time period and the predetermined time set by the setting unit. That is, a user can set at least one of the predetermined time period and the predetermined time each for reading the information relating to the replacement unit, so that a user can select one operation mode corresponding to the replacement unit of the genuine type or another operation mode in accordance with the setting.

Further, preferably, the image forming device further includes a display unit for displaying in accordance with the discrimination result of the discriminating unit. Thus, a user can select one operation mode corresponding to the replacement unit of the genuine type or another operation mode after confirming the discrimination result of the discriminating unit.

According to a fourth aspect of the invention there is provided an image forming device including: a device main body; at least one replacement unit attached to the device main body in an exchangeable manner; a reading unit for reading information relating to the replacement unit from the replacement unit; a discriminating unit for discriminating whether the replacement unit is a genuine type or one other than the genuine type in accordance with the information read from the reading unit; a switching unit for switching a current operation mode into one operation mode corresponding to the replacement unit of the genuine type or another operation mode different from the one operation mode in accordance with the discrimination result of the discriminating unit, wherein the reading unit reads the information relating to the replacement unit in accordance with at least one of a predetermined time period and a predetermined time.

That is, the reading unit reads the information relating to the replacement unit in accordance with at least one of the predetermined time period and the predetermined time, and it is discriminated whether the replacement unit is the genuine type or one other than the genuine type in accordance with the information thus read. Thus, a user can use the replacement unit other than the genuine type even when the user does not select the operation mode.

Preferably, the reading unit reads the information relating to the replacement unit in accordance with at least one of a predetermined time period and a predetermined time. Further, preferably, the reading unit includes a setting unit for setting at least one of the predetermined time period and the predetermined time each for reading the information relating to the replacement unit, and the reading unit reads the information relating to the replacement unit in accordance with at least one of the predetermined time period and the predetermined time set by the setting unit.

According to the invention, even when a replacement unit other than a genuine type is attached, a replacement unit other than a genuine type can be used by the intent of a user. Further, according to the invention, when the power supply of the device main body is turned on, the control can be performed in accordance with a replacement unit having been attached even when the replacement unit is attached in the turning-off state of the power supply of the device main body.

Further, according to the invention, a replacement unit other than the genuine type can be used according to the intension of a user even when the replacement unit other than the genuine type is attached.

BRIEF DESCRIPTION OF THE DRAWINGS

These and other objects and advantages of this invention will become more fully apparent from the following detailed description taken with the accompanying drawings in which:

FIGS. 16A and 16B are graphs showing the results corrected by the setting shown in FIG. 15, wherein FIG. 16A shows the corrected toner density and FIG. 16B is a graph showing the corrected image density.

FIGS. 20A to 20C are diagrams exemplarily showing screens displayed on a UI device, wherein FIG. 20A shows a switching confirmation screen for making a user confirm that the operation mode is to be switched, FIG. 20B shows a replacement request screen for requesting a user to exchange a genuine-type toner cartridge for a toner cartridge having been attached, and FIG. 20C shows a switching selecting screen in order for a user to select whether the operation mode is to be switched automatically or manually.

FIGS. 26A and 26B are diagrams showing examples of screens displayed on a UI device, wherein FIG. 26A shows a setting input screen for polling (interval time period) and FIG. 26B shows a setting input screen for designating the time of communication.

DETAILED DESCRIPTION OF THE PREFERRED EMBODIMENTS

First Embodiment

An embodiment of the invention will be explained based on accompanying drawings.

Figure 1:
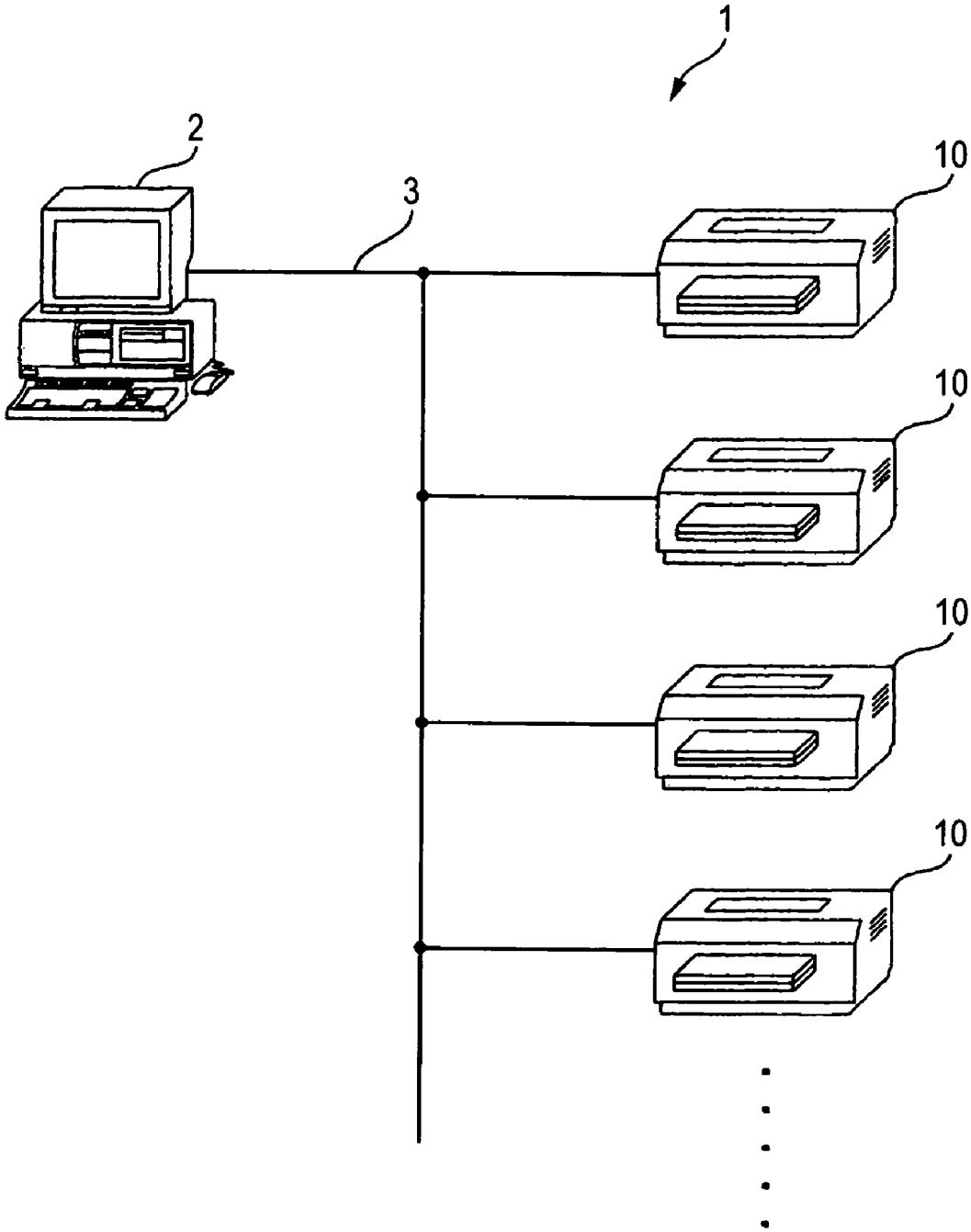
FIG. 1 is a schematic diagram showing an image forming system according to an embodiment of the invention.

An image forming system 1 according to an embodiment of the invention is shown in FIG. 1. The image forming system 1 is configured in a manner that a host device 2 such as a PC (personal computer) is coupled to a plurality of image forming devices 10, for example, through a network 3. The host device 2 includes a control device such as an MCU (micro controller unit), an input/output device such as a touch panel and a communication device for transmitting and receiving a signal through the network 3. The host device may be a terminal other than a PC. The network 3 may be a wired network or a wireless network. Further, a plurality of the host devices 2 may be coupled to the network 3.

In this manner, the image forming system 1 is configured in a manner that the host device 2 can control the image forming device 10 through the network 3.

Figure 2:
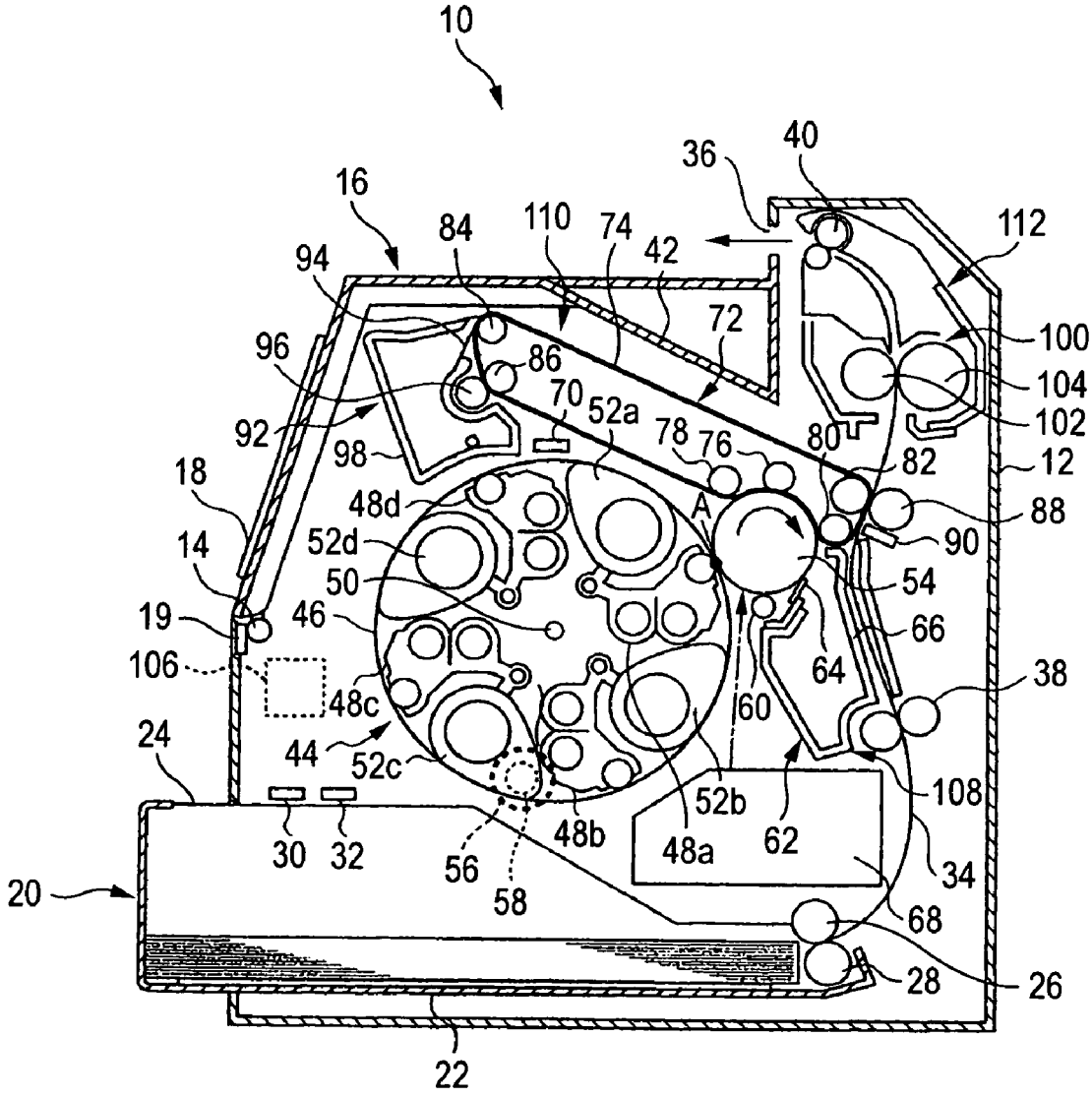
FIG. 2 is a side view showing the gist of an image forming device according to the embodiment of the invention.

FIG. 2 shows the schematic configuration of the image forming device 10. The image forming device 10 has an image forming device main body 12. An open/close cover 16 is provided at the upper portion of the image forming device main body 12 so as to be freely rotatable around a rotation fulcrum 14. A user interface (UI) device 18 such as a touch panel is provided at the front face side (the left side in FIG. 2) of the open/close cover 16. The UI device 18 displays control information and instruction information etc. of the image forming device 10 and receives instruction information etc. inputted by a user. That is, a user can operate the image forming device 10 through the UI device 18. Incidentally, the UI device 18 may be configured to perform only the reception of an input from a switch etc. or to perform only the delivery of output such as a display output or to perform both the reception and delivery.

Near the rotation fulcrum 14, an open/close detection sensor 19 is provided which is arranged to be made in contact and separate in accordance with the opening/closing operation of the open/close cover 16 thereby to detect the opening/closing of the open/close cover 16, for example.

A sheet feed unit 20 with one shelf, for example, is provided at the lower portion of the image forming device main body 12. The sheet feed unit 20 includes a paper feed unit main body 22 and a paper feed cassette 24 in which papers are housed. At the upper portion near the inner end of the paper feed cassette 24, there are disposed a feed roller 26 for feeding papers from the paper feed cassette 24 and a retard roller 28 for handling papers to be fed one by one. Further, at the upper portion of the paper feed cassette 24, there are provided with a temperature sensor 30 for detecting a temperature within the image forming device main body 12 and a humidity sensor 32 for detecting a humidity within the image forming device main body 12.

A transport path 34 is a paper path from the feed roller 26 to an ejection port 36. The transport path 34 is formed in an almost vertical direction so as to extend from the sheet feed unit 20 to a fusing device 100 described later, near the rear side (the right side surface in FIG. 2) of the image forming device main body 12. A secondary transfer roller 88 and a secondary transfer backup roller 82 described later are disposed at the upper stream side of the fusing device 100 of the transport path 34. A resist roller 38 is disposed at the upper stream side of the secondary transfer roller 88 and the secondary transfer backup roller 82. Further, an ejection roller 40 is disposed near the ejection port 36 of the transport path 34.

Thus, sheets of paper sent out by the feed roller 26 from the paper feed cassette 24 of the sheet feed unit 20 are handled by the retard roller 28 and so only a sheet of paper at the uppermost position is introduced on the transport path 34 and temporarily stopped by the resist roller 38. Then, the sheet of paper is passed between the secondary transfer roller 88 and the secondary transfer backup roller 82 described later at a suitable timing and so a toner image is transferred on the sheet of paper. The toner image thus transferred is fixed on the sheet of paper by the fusing device 100, then the sheet of paper is ejected from the ejection port 36 by the ejection roller 40 and placed on an ejection portion 42 provided at the upper portion of the open/close cover 16. The ejection portion 42 is arranged in a manner that the surface thereof near the ejection port forms the lowest surface and the surface is inclined upward gradually toward the front direction (the left direction in FIG. 2).

A developing unit 44 such as a rotary developing device is disposed at almost the center portion of the image forming device main body 12, for example. The developing unit 44 has a developing unit main body 46. Four developers 48*a* to 48*d* for forming a toner image are attached to the developing unit main body 46. These developers 48*a* to 48*d* rotate counterclockwise (in FIG. 2) around a rotation shaft 50 together with the developing unit main body 46. Cylindrical toner cartridges 52*a* to 52*d* for housing toners of yellow (Y), magenta (M), cyan (C) and black (B) are attached to the developers 48*a* to 48*d*, respectively. When the toner cartridges 52*a* to 52*d* are attached to the developing unit main body 46 through the developers 48*a* to 48*d*, respectively, the outer surfaces of the toner cartridges are almost made coincide with the outer periphery of the developing unit main body 46.

An image carrier 54 made of photosensitive material, for example, is disposed so as to abut against the developing unit 44 from the rear surface side (the right side in FIG. 2) of the image forming device 10. That is, the developing unit 44 is provided with four colors Y, M, C, K for the full color development. The developers 48*a* to 48*d* are rotated and sequentially positioned at the position opposing to the image carrier 54 and serve to develop a latent image on the image carrier 54 with yellow (Y), magenta (M), cyan (C) and black (B) sequentially.

A radio communication portion 56 is disposed near a position of the developing unit 44 almost opposing to the image carrier 54 through the rotation shaft 50. The radio communication portion 56 has an antenna 58 and performs radio communication with a memory chip 170.

A charging device 60 constituted by a charger roller, for example, for uniformly charging the image carrier 54 is provided at the lower end portion of the image carrier 54. An image carrier cleaner 62 abuts against the image carrier 54 at a position on the upstream side than the charging device 60 in the rotation direction of the image carrier. The image carrier cleaner 62 is constituted by a cleaning blade 64 for scraping toners remained on the image carrier 54 after the primary transfer, for example, and a remaining toner collection bottle 66 for collecting toner scraped by the cleaning blade 64.

Incidentally, a rib etc., for example, is formed at the rear surface side (the right side in FIG. 2) of the remaining toner collection bottle 66 in a manner that the rib is formed in a curved surface shape so that sheets of paper are transported thereon smoothly and it forms a part of the transport path 34.

An exposure device 68 for writing a latent image by using a light ray such as a laser light on the image carrier 54 charged by the charging device 60 is disposed beneath the rear surface side of the developing unit 44. An unuse detection sensor 70 such as a reflection type photo sensor, for example, for detecting whether or not the toner cartridges 52*a* to 52*d* attached to the developing unit 44 is in an unuse state is disposed above the developing unit 44. Above the developing unit 44 and the unuse detection sensor 70, an intermediate transfer device 72 is provided which is arranged to, after primarily-transferring one color by one color the toner image visualized by the developing unit 44 on an intermediate transfer member at a primary-transfer position at every one revolution of the intermediate transfer member 74 thereby to overlap the four-color toner images on the intermediate transfer member 74, collectively transfer the four-color toner images on a sheet of paper at a secondary transfer position described later.

The intermediate transfer device 72 is constituted by the intermediate transfer member 74 such as an intermediate transfer belt, a primary transfer roller 76, a wrap-in roller 78, a wrap-out roller 80, the secondary transfer backup roller 82, a scraper backup roller 84 and a brush backup roller 86. The intermediate transfer member 74 has elasticity, for example, and is extended in an almost flat shape so as to have long sides and short sides above the developing unit 44. The long side of the upper surface side of the intermediate transfer member 74 is extended so as to be almost in parallel to the ejection portion 42 provided at the upper portion of the image forming device main body 12. Further, the intermediate transfer member 74 has a primary transfer portion (image carrier wrap area) which abuts against the image carrier 54 in a wrapped manner between the wrap-in roller 78 disposed at the upstream side of the primary transfer roller 76 in the long side of the lower surface side and the wrap-out roller 80 disposed at the downstream side of the primary transfer roller 76. The intermediate transfer body is wound at the primary transfer portion around the image carrier 54 by a predetermined area and so driven in accordance with the rotation of the image carrier 54.

Further, a flat portion (short side) is formed at the rear surface side (the right surface side in FIG. 2) of the intermediate transfer member 74 by the wrap-out roller 80 and the secondary transfer backup roller 82 in a manner that the flat surface portion forms a secondary transfer portion and faces on the transport path 34.

In this manner, the intermediate transfer member 74 primarily-transfers a toner image formed on the image carrier 54 onto the intermediate transfer member in an overlapping manner in the order of yellow, magenta, cyan and black, for example, and transports the toner image thus primarily-transferred toward the secondary transfer portion.

The scraper backup roller 84 assists the scraping operation performed by a scraper 94 described later which scraps residual toner on the intermediate transfer member 74 after the secondary transfer. The brush backup roller 86 assists the scraping operation performed by a brush roller 96 described later which scraps residual toner on the intermediate transfer member 74 after the secondary transfer.

A secondary transfer roller 88 is opposed to the secondary transfer backup roller 82 of the intermediate transfer device 72 through the transport path 34. That is, the secondary transfer position of the secondary transfer portion is formed between the secondary transfer roller 88 and the secondary transfer backup roller 82. The secondary transfer roller 88 secondarily-transfers on a sheet of paper the toner image having been primarily-transferred on the intermediate transfer member 74 at the secondary transfer position by the assistance of the secondary transfer backup roller 82. In this case, the secondary transfer roller 88 is arranged to separate from the intermediate transfer member 74 during the three revolutions of the intermediate transfer member 74, that is, while the intermediate transfer member transports three-color toner images of yellow, magenta and cyan and to abut against the intermediate transfer member 74 when a black toner image is transferred. The secondary transfer roller 88 and the secondary transfer backup roller 82 are arranged to cause a predetermined voltage difference therebetween. For example, when the secondary transfer roller 88 is set to have a high voltage, the secondary transfer backup roller 82 is coupled to the ground (GND) etc.

An image density sensor 90 such as a reflection type photo sensor is disposed so as to oppose to the intermediate transfer member 74 through the transport path 34. The image density sensor 90 reads the patch of toner formed on the intermediate transfer member 74 to detect the density of an image formed on the intermediate transfer member 74.

An intermediate transfer member cleaner 92 is provided so as to abut against the intermediate transfer member at one end side of the intermediate transfer member 74 in opposite to the image carrier side. The intermediate transfer member cleaner 92 is configured by the scraper 94 for scraping toner remained on the intermediate transfer member 74 after the secondary transfer, for example, to clean the intermediate transfer member, the brush roller 96 for further scraping toner remained after the cleaning of the scraper 94, and a used toner collection bottle 98 for collecting the toner scraped by the scraper 94 and the brush roller 96. The scraper 94 is formed by a thin plate of stainless, for example, and applied with the voltage of a polarity opposite to that of toner. The brush roller 96 is formed by a brush of acrylic subjected to the electric conductivity processing, for example. Both the scraper 94 and the brush roller 96 are separated from the intermediate transfer member 74 while the intermediate transfer member 74 transports a toner image and abut integrally against the intermediate transfer member 74 at a predetermined timing.

The fusing device 100 is disposed above the secondary transfer position. The fusing device 100 has a heat roller 102 and a pressure roller 104 and serves to fix the toner image secondarily-transferred on a sheet of paper by the secondary transfer roller 88 and the secondary transfer backup roller 82 onto the sheet of paper and transfer the sheet of paper thus fixed toward the ejection roller 40.

Further, a control portion 106 for controlling the respective portions constituting the image forming device 10 is disposed within the image forming device main body 12.

An image carrier unit 108 is configured by integrating the image carrier 54, the charging device 60 and the image carrier cleaner 62. Further, an image forming unit 110 is configured by integrating the image carrier unit 108, the intermediate transfer device 72 and the intermediate transfer member cleaner 92. Furthermore, a fixing unit 112 is configured by integrating the fusing device 100 and the ejection roller 40.

Figure 3:
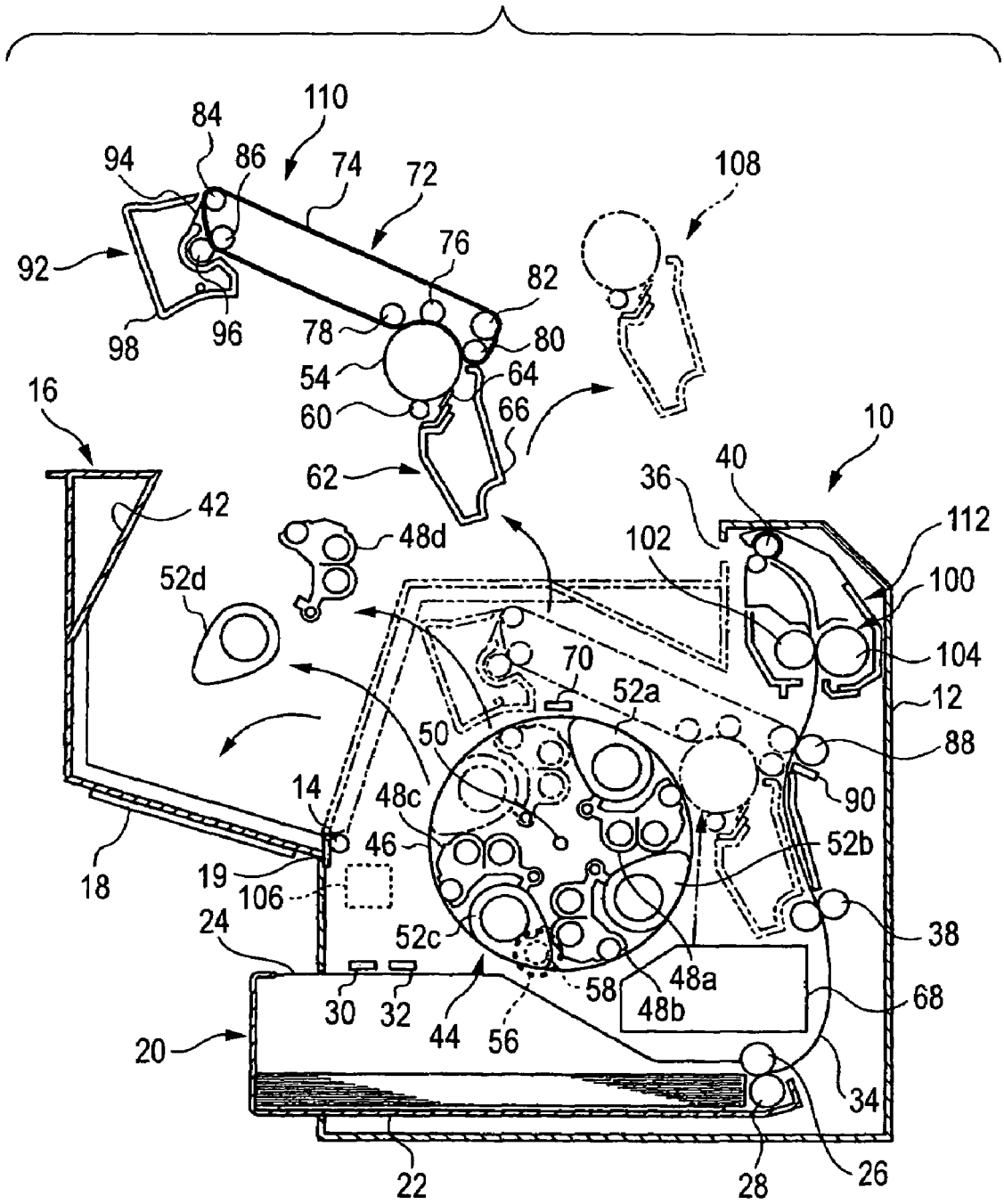
FIG. 3 is a side view exemplarily showing a state where a replacement unit of the image forming device according to the embodiment of the invention is separated from the main body of the image forming device.

As also shown in FIG. 3, the image forming unit 110 is arranged to be freely detachable with respect to the image forming device main body 12 and can be made detachable by opening the open/close cover 16. Further, the image carrier unit 108 is arranged to be freely detachable with respect to the image forming unit 110.

The toner cartridges 52*a* to 52*d* are arranged to be freely detachable with respect to the developers 48*a* to 48*d* attached to the developing unit main body 46, respectively, when the open/close cover 16 is opened and the toner cartridge is positioned at the front side (the open/close cover 16 side). The developers 48*a* to 48*d* are arranged to be freely detachable with respect to the developing unit main body 46 when the open/close cover 16 is opened and the developer is positioned at the front side (the open/close cover 16 side).

The fixing unit 112 is arranged to be freely detachable with respect to the image forming device main body 12 when a not-shown upper cover is removed. Further, other units such as the developing unit 44 and the sheet feed unit 20 are made detachable with respect to the image forming device main body 12.

In this manner, each of the units is made exchangeable by a user. In the case where a user attaches a replacement unit to the image forming device 10, when a unit other than a genuine type for the image forming device 10 is attached, there may arise such a problem that good image quality can not be maintained or the operation of the device can not be guaranteed. This is because the image forming device 10 controls the image forming process in view of the characteristics of the members etc. used in the image forming device 10. Thus, a sensor(s) for detecting a predetermined condition(s) etc. is provided at the unit exchangeable by a user etc.

Hereinafter, a constituent element configured by a plurality of constituent portions such as the developers 48*a* to 48*d* will may be abbreviated merely as "the developer 48", for example, when arbitrary one of these constituent portions is referred to.

Next, the explanation will be made as to an example of a replacement unit having sensors for detecting the predetermined conditions etc.

Figure 4:
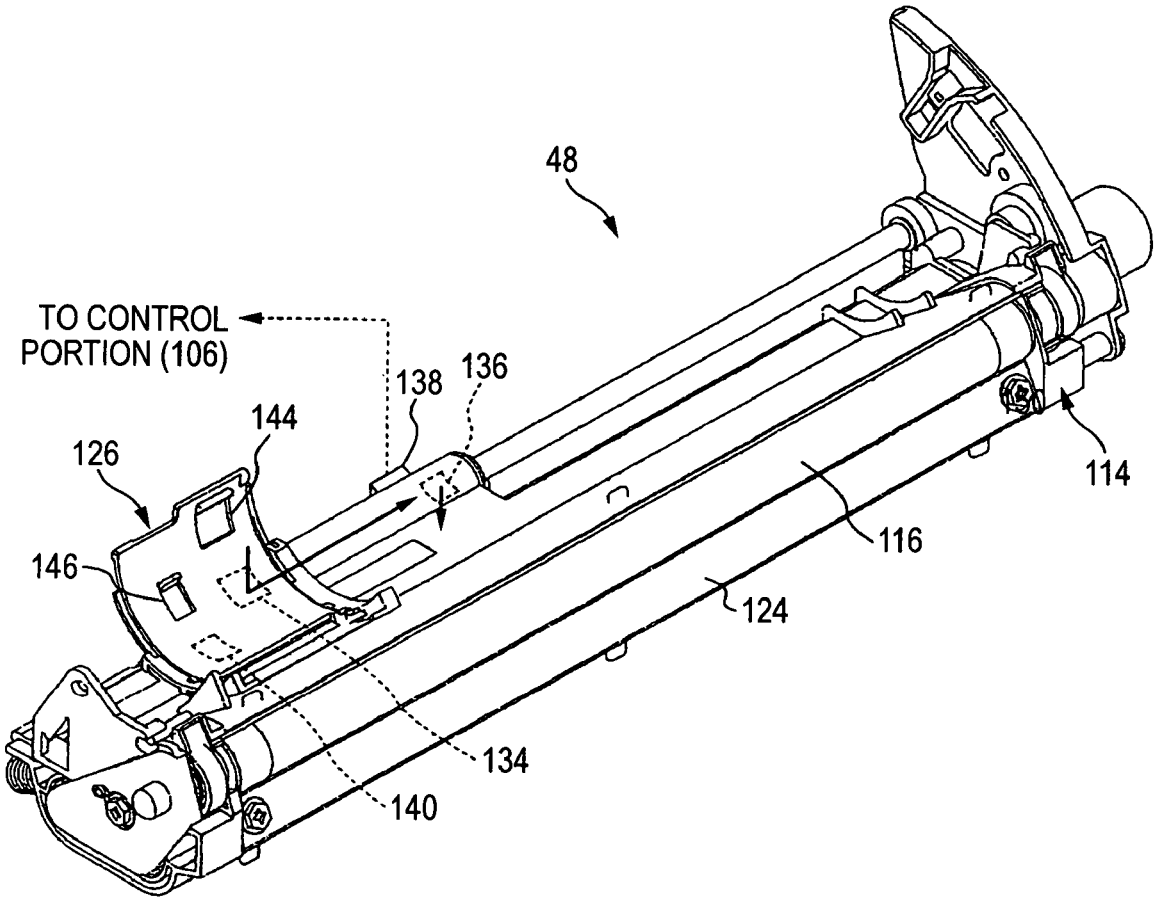
FIG. 4 is a perspective view showing a developer of the image forming device according to the embodiment of the invention.
Figure 5:
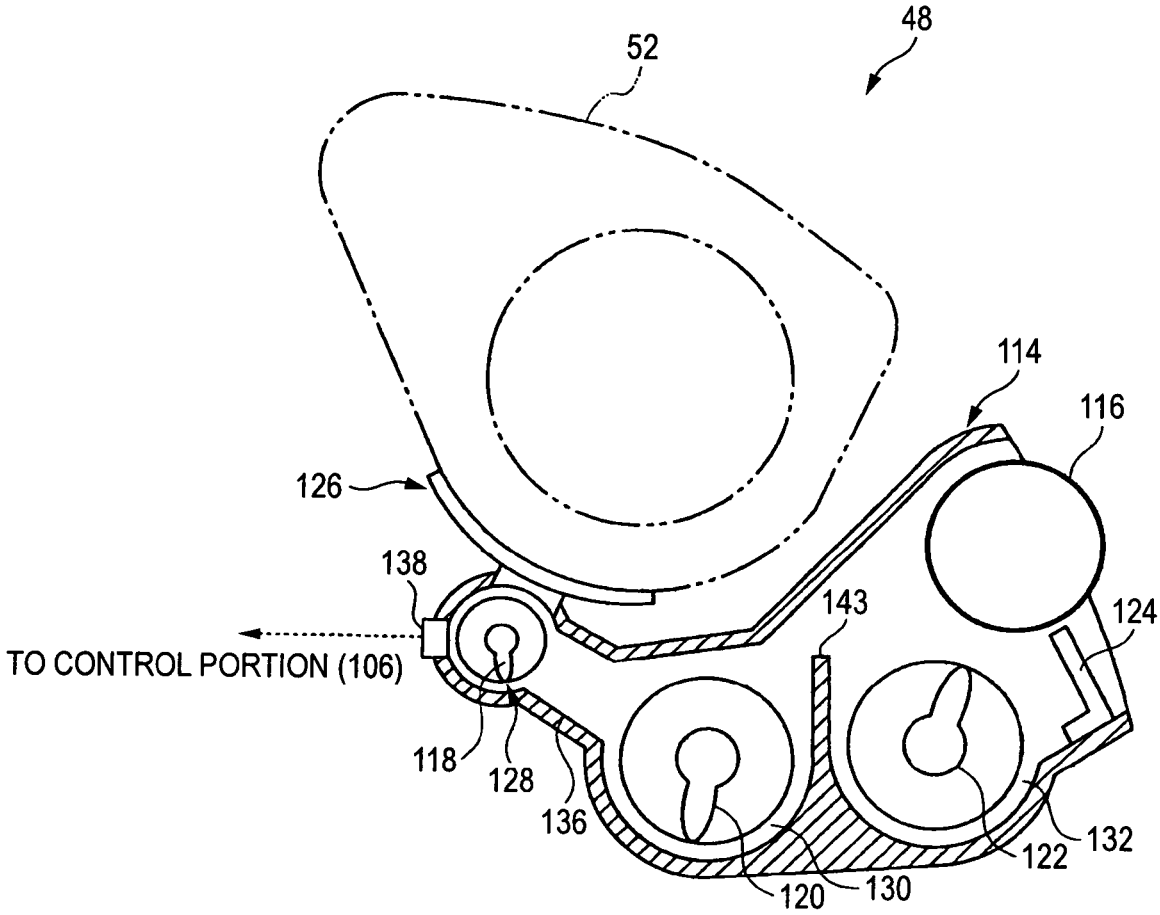
FIG. 5 is a schematic diagram showing a section of the developer of the image forming device according to the embodiment of the invention.

FIGS. 4 and 5 show the configuration of the developer 48 as a replacement unit.

The developer 48 has a developing roller 116, a first auger 118, a second auger 120, a third auger 122 and a layer thickness restriction member 124 as developing agent carrier disposed on the image carrier 54 side of a developer housing (developer main body) 114 and houses therein developing agent of two component system constituted by non-magnetic toner and magnetic carrier, for example.

The developer housing 114 has a shutter 126 for opening and closing a toner receiving port 134 and a developing agent exhaust port 140 described later, a take-in transport path 128 of a cylindrical shape for transporting toner taken from the toner cartridge 52, and developing agent transport paths 130, 132 of cylindrical shapes each for stirring and transporting toner and carrier.

The take-in transport path 128 has the toner receiving port 134 for receiving toner from the toner cartridge 52 and a toner sending port 136 for sending toner to the developing agent transport path 130. The first auger 118 is disposed within the take-in transport path 128. The first auger 118 transports, toward the developing agent transport path 130, toner having been received by the take-in transport path 128 from the toner cartridge 52. Further, an amount of toner supplied to the developer 48 from the toner cartridge 52 is adjusted by adjusting the rotation of the first auger 118. Thus, a CPU 202 described later may accumulate the driving time or rotation number of the first auger 118 thereby to calculate a used amount of toner (a used amount of the toner cartridge 52). Further, a used amount of toner may be calculated in a manner that a current flowing at the time where the exposure device 68 writes an electrostatic latent image on the image carrier 54 is accumulated in a capacitor as electric charges and the CPU 202 counts the number of times where the accumulated electric charges reaches a predetermined amount thereby to calculate the used amount.

In the take-in transport path 128, a toner presence/non-presence detection sensor 138 is provided between the toner receiving port 134 and the toner sending port 136. The toner presence/non-presence detection sensor 138 detects the change of a resistance value depending on the presence or non-presence of toner between two points within the take-in transport path 128, for example, thereby to detect the presence or non-presence of toner within the take-in transport path 128. Further, the toner presence/non-presence detection sensor 138 may be a piezo-electric element.

The developing agent transport path 130 has the developing agent exhaust port 140 for exhausting excessive developing agent to the toner cartridge 52. The second auger 120 is disposed within the developing agent transport path 130. The second auger 120 stirs and mixes toner transported through the take-in transport path 128 and carrier and then transports the toner and carrier thus mixed to the developing agent transport path 132.

The third auger 122 is disposed within the developing agent transport path 132. The third auger 122 stirs and transports the developing agent transported through the developing agent transport path 130 and supplies the developing agent thus stirred to the developing roller 116.

A partitioning plate 143 is provided between the developing agent transport path 130 and the developing agent transport path 132. A path (not shown) for coupling the developing agent transport path 130 and the developing agent transport path 132 is provided at the both ends of the partitioning plate 143. Thus, when the second auger 120 and the third auger 122 transport the developing agent in opposite directions to each other, toner is rubbed and charged to a predetermined charging amount of a predetermined polarity by carrier and then circulated within the developer housing 114. Further, since deteriorated developing agent is exhausted from the developing agent exhaust port 140 to the toner cartridge 52 at a predetermined timing, the total life time of developing agent can be elongated (trickle developing method).

The shutter 126 has opening portions 144 and 146. The opening portion 144 is overlapped on the toner receiving port 134 to form a path for toner to the developer 48 from the toner cartridge 52. The opening portion 146 is overlapped on the developing agent exhaust port 140 to form a path for excessive developing agent to the toner cartridge 52 from the developer 48.

The developing roller 116 carries toner and abuts against the image carrier 54 thereby to develop an electrostatic latent image carried by the image carrier 54 by means of toner. The layer thickness restriction member 124 restricts the layer thickness of toner carried by the developing roller 116.

Figure 6:
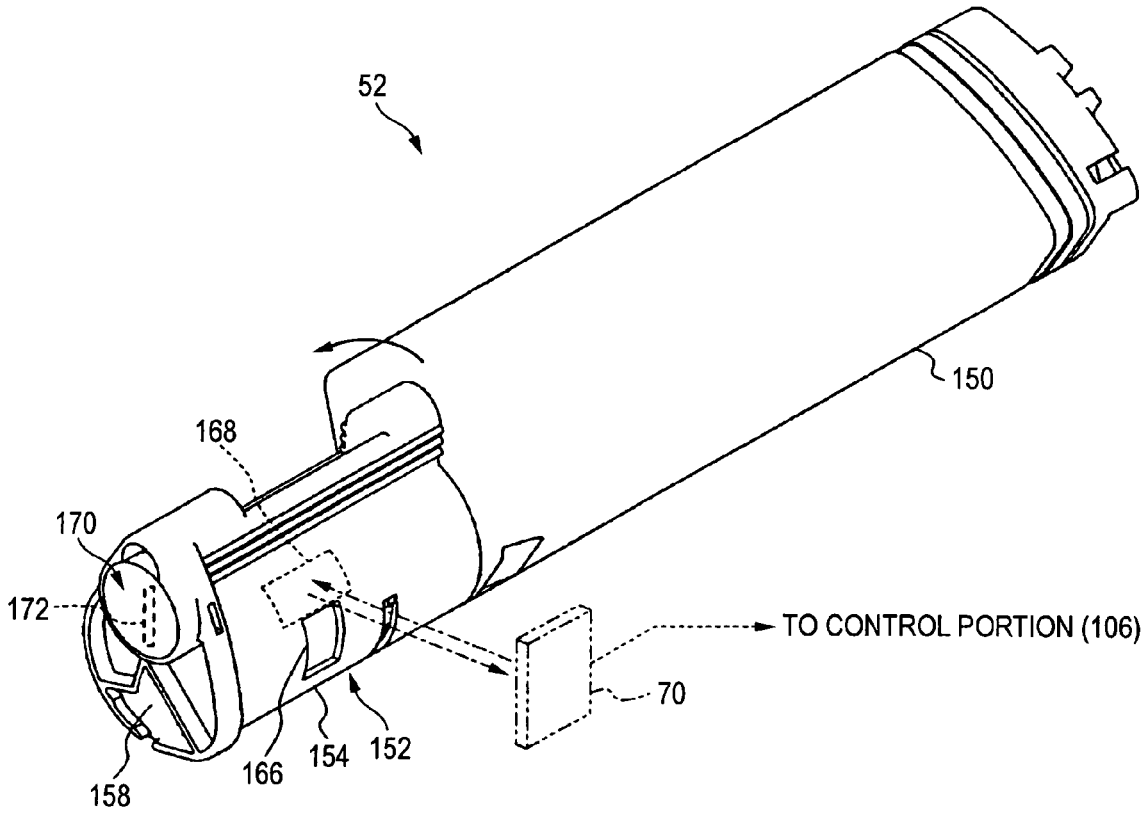
FIG. 6 is a perspective view showing a toner cartridge of the image forming device according to the embodiment of the invention.
Figure 7:
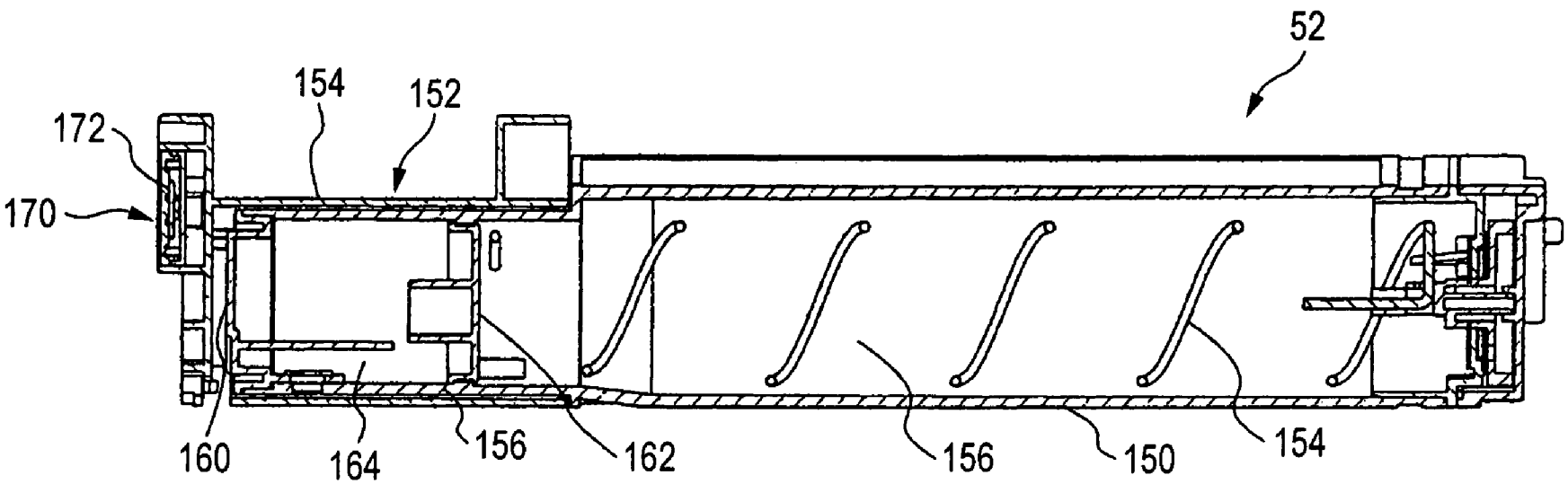
FIG. 7 is a perspective view showing the toner cartridge of the image forming device according to the embodiment of the invention.

The configuration of the toner cartridge 52 as a replacement unit is shown in FIGS. 6 and 7.

The toner cartridge 52 has a toner cartridge main body 150 and a rotation portion 152 provided at the one end in the longitudinal direction of the toner cartridge main body 150.

The toner cartridge main body 150 is formed in a tubular shape and is configured by integrally forming a portion of an almost cylindrical shape within which a stirring transport member 154 is disposed and a portion which extends and is gradually narrowed in a direction almost orthogonal with respect to the longitudinal direction of the almost cylindrical portion from the almost cylindrical portion. Further, the toner cartridge main body 150 is arranged in a manner that the outer periphery thereof almost fits to the outer periphery of the developing unit main body 46 when the toner cartridge 52 is attached to the developing unit main body 46 through the developer 48.

A toner housing space 156 for housing toner to be supplied to the developer 48 is formed within the toner cartridge main body 150. The aforesaid stirring transport member 154 is provided within the toner housing space 156. The stirring transport member 154 is wound in a spiral manner, for example, and stirs toner within the toner housing space 156 and transports the toner toward the toner receiving port 134 of the developer 48.

The rotation portion 152 has a rotation portion main body 154 and a tubular portion 156 of a cylindrical shape which is provided within the rotation portion main body 154 and formed integrally with the toner cartridge main body 150. The tubular portion 156 is sealed by a tubular portion side wall 160 at the side surface portion 158 of the rotation portion main body 154 and is provided with a separation wall 162 therein. A developing agent collection space 164 for collecting excessive developing agent from the developer 48 is formed on the tubular portion side wall 160 side of the separation wall 162. The aforesaid toner housing space 156 is formed in an extended manner on the tubular portion side wall 160 side of the separation wall 162.

The rotation portion main body 154 has a window portion 166 of a window shape covered by a transparent member and is arranged to be a cylindrical shape in its inside and rotate along the outer surface of the cylindrical portion of the tubular portion 156. Further, a reflection member 168 such as a white tape is attached to the outer surface of the cylindrical portion of the tubular portion 156. The reflection member 168 is arranged to be exposed through the window portion 166 when the toner cartridge 52 is attached to the developer 48 and the rotation portion main body 154 rotates. Furthermore, when the developing unit 44 to which the toner cartridge 52 is attached rotates within the image forming device main body 12, the reflection member 168 thus exposed passes a position opposing to the unuse detection sensor 70 fixed to the image forming device main body 12. As described above, the unuse detection sensor 70 is a reflection-type photo sensor, for example. When the reflection member 168 of the toner cartridge 52 attached to the developing unit 44 passes the position opposing to the unuse detection sensor 70, the reflection member 168 detects a light reflection amount which changes depending on the degree of contamination due to toner thereby to detect whether or not the toner cartridge 52 is a unused one.

A memory chip 170 is attached to the side surface portion 158 of the rotation portion main body 154. The memory chip 170 has an antenna 172 thereby to radio-communicate with the radio communication portion 56 provided on the image forming device main body 12 side.

Next, the explanation will be made as to the respective circuit configurations of the radio communication portion 56 and the memory chip 170 and also as to the communication performed therebetween.

Figure 8:
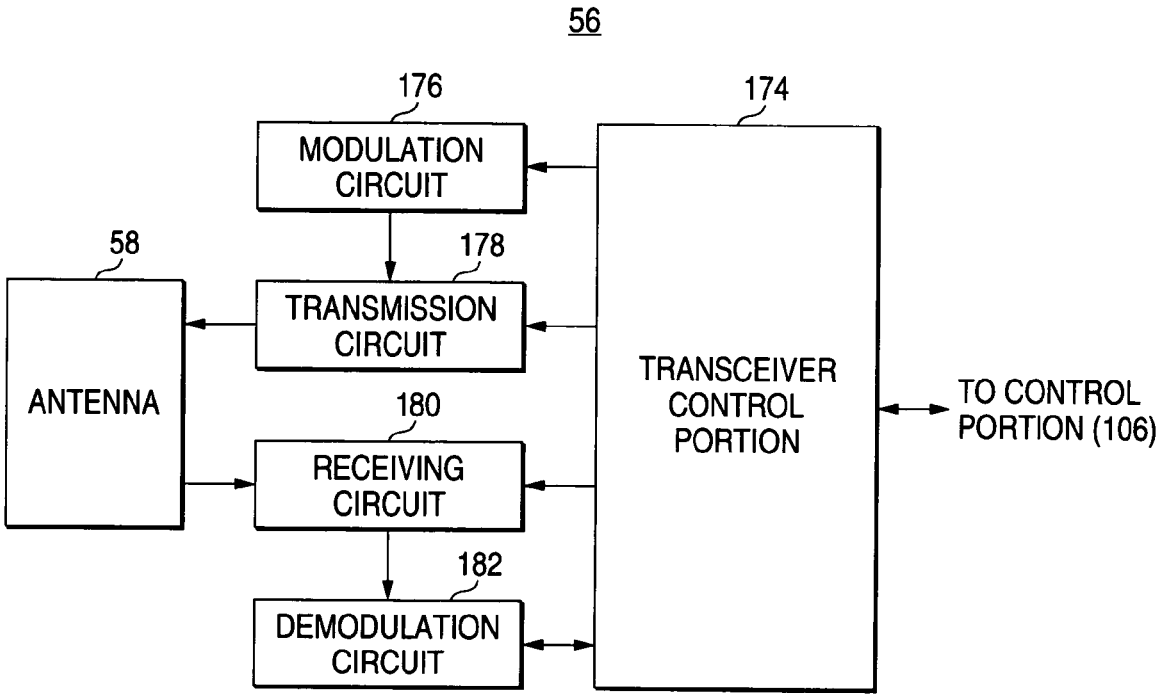
FIG. 8 is a block diagram showing the circuit configuration of a radio communication portion of the image forming device according to the embodiment of the invention.
Figure 9:
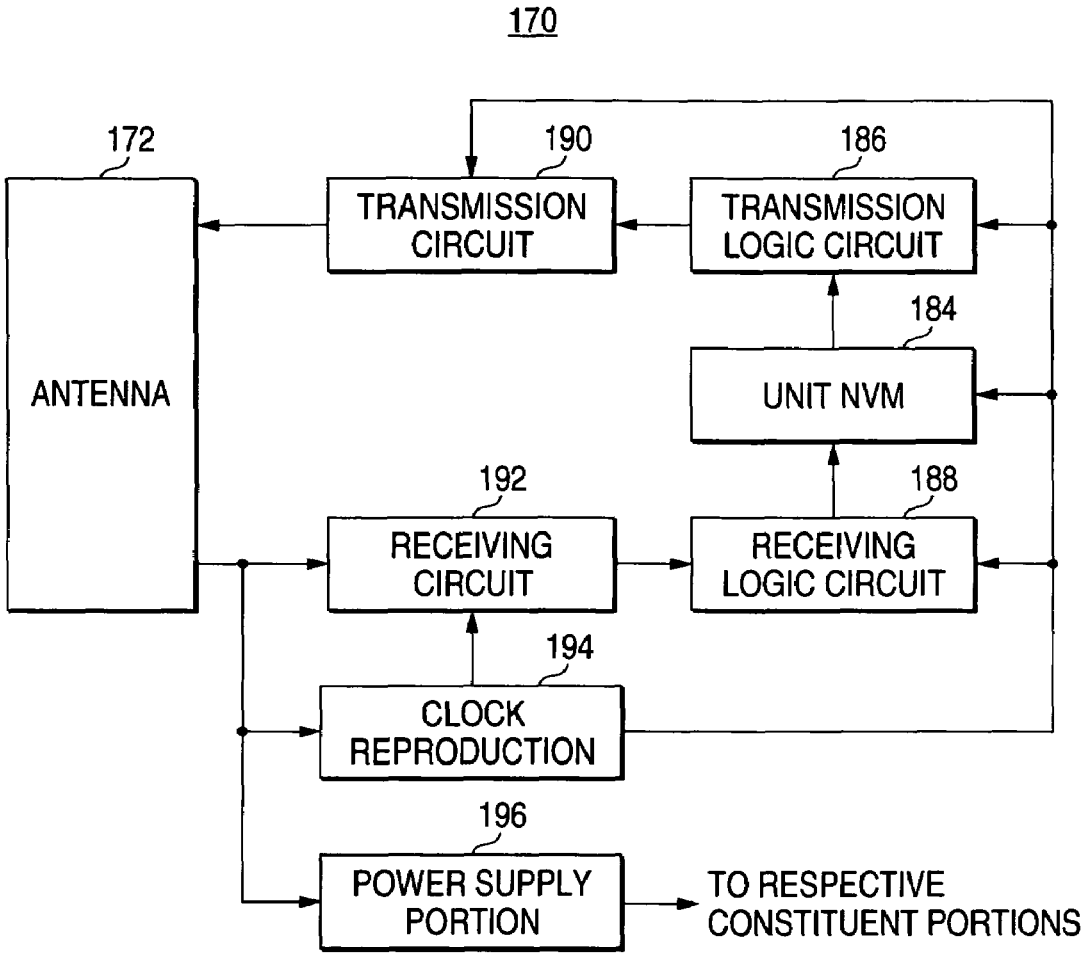
FIG. 9 is a block diagram showing the circuit configuration of the memory chip of the toner cartridge used in the image forming device according to the embodiment of the invention.

FIG. 8 is a block diagram showing the circuit configuration of the radio communication portion 56. FIG. 9 is a block diagram showing the circuit configuration of the memory chip 170.

As shown in FIG. 8, the circuit of the radio communication portion 56 is configured by a transceiver control portion 174, a modulation circuit 176, a transmission circuit 178, a receiving circuit 180, a demodulation circuit 182 and the antenna 58. In the radio communication portion 56, the transceiver control portion 174 controls the operations of the respective constitutional portions of the radio communication portion 56. The transceiver control portion 174 outputs data having been inputted from the control portion 106 to the modulation circuit 176. Further, the transceiver control portion 174 outputs data which was received by the receiving circuit 180 and modulated by the demodulation circuit 182 to the control portion 106. The modulation circuit 176 modulates data inputted from the transceiver control portion 174 and outputs the data thus modulated to the transmission circuit 178. The transmission circuit 178 outputs a radio wave signal including data to be stored in the memory chip 170, a clock signal etc. to the memory chip 170 through the antenna 58.

The receiving circuit 180 receives a signal transmitted from the memory chip 170 through the antenna 58 and outputs the signal thus received to the demodulation circuit 182. The demodulation circuit 182 demodulates data transmitted from the memory chip 170 based on the change of the signal inputted from the receiving circuit 180 and outputs the demodulated data to the transceiver control portion 174.

As shown in FIG. 9, the circuit of the memory chip 170 is configured by a unit NVM (Non Volatile Memory) 184, a transmission logic circuit 186, a receiving logic circuit 188, a transmission circuit 190, a receiving circuit 192, a clock reproducing circuit 194, a power supply portion 196 and the antenna 172.

When the radio wave signal is transmitted to the memory chip 170 from the radio communication portion 56, the receiving circuit 192, the clock reproducing circuit 194 and the power supply portion 196 receive this radio wave signal through the antenna 172. In the memory chip 170, when the power supply portion 196 receives the radio wave signal, the power supply portion rectifies a current generated by the electromagnetic induction due to the radio wave signal and supplies to each of the constitutional portions of the memory chip 170 an electric power necessary for the operations thereof. The memory chip 170 may be configured to be supplied with an electric power from the main body portion 40 when a voltage higher than that generated by the power supply portion 196 is necessary, for example. For example, the memory chip 170 may be further provided with a coil etc. for the power supply so that an electric power is supplied through an a.c. power supplied to the developing unit 44 in a non-contact manner.

The clock reproducing circuit 194 generates the clock signal when receives the radio wave signal and supplies the clock signal to the respective circuits constituting the memory chip 170. The receiving circuit 192 outputs, when receives the radio wave signal, to the receiving logic circuit 188 a signal such as data contained in the radio wave signal in synchronism with the clock signal inputted from the clock reproducing circuit 194. The receiving logic circuit 188 demodulates a signal such as data inputted from the receiving circuit 192 in synchronism with the clock signal inputted from the clock reproducing circuit 194 and outputs the demodulated signal to the unit NVM 184.

The unit NVM 184 is a non volatile memory capable of being written therein. When a signal inputted from the receiving logic circuit 188 represents data writing, the unit NVM writes (stores) the data therein in synchronism with the clock signal inputted from the clock reproducing circuit 194. In contrast, when a signal inputted from the receiving logic circuit represents data reading, the unit NVM outputs the data stored in the unit NVM 184 to the transmission logic circuit 186 in synchronism with the clock signal. The non volatile memory contained in the unit NVM 184 may be a flash ROM, EEPROM, or FeRAM (ferroelectric memory) etc.

The transmission logic circuit 186 modulates data inputted from the unit NVM 184 in synchronism with the clock signal inputted from the clock reproducing circuit 194 and outputs the modulated data to the transmission circuit 190. The transmission circuit 190 transmits the signal inputted from the transmission logic circuit 186 to the radio communication portion 56 through the antenna 172 as a radio wave signal in synchronism with the clock signal inputted from the clock reproducing circuit 194.

Incidentally, a signal to be transmitted and received as a radio wave signal may be encrypted, then converted into a radio wave signal and transmitted or received. Further, a permitted user etc., for example, may be able to rewrite the contents of the unit NVM 184 from the device other than the control portion 106 by using the encrypted radio wave signal.

Figure 10:
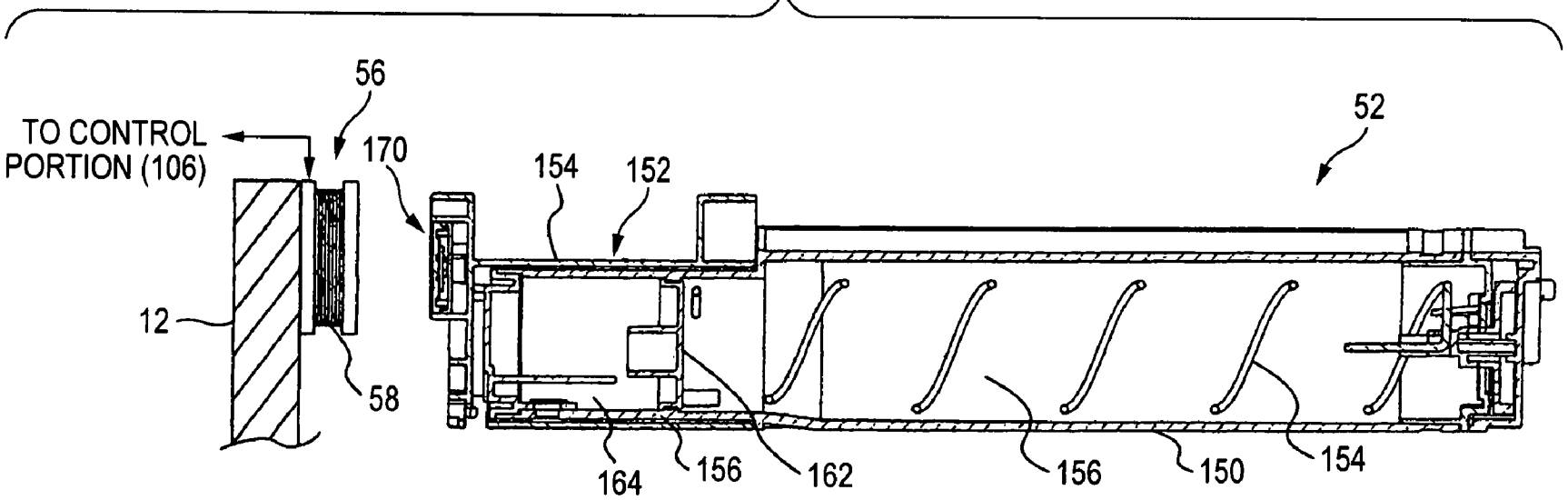
FIG. 10 is a sectional view showing the positional relationship between the memory chip and the radio communication portion between which radio communication is performed.

FIG. 10 shows the positional relation between the radio communication portion 56 and the memory chip 170 between which the radio communication is performed. As described above, the toner cartridges 52 are respectively attached to the developers 48 and move when the developing unit 44 (FIG. 2) rotates around the rotation shaft 50. The radio communication portion 56 is fixed to the image forming device main body 12 near the side portion of the developing unit 44 so that the radio communication portion almost opposes sequentially to the memory chips 170 which move in accordance with the rotation of the developing unit 44. The radio communication portion communicates with the corresponding one of the memory chips 170 in a state where the corresponding developer 48 is controlled in its movement and stopped at the position almost opposing to the radio communication portion so that the radio communication portion is able to communicate with the corresponding memory chip. Further, the radio communication portion 56 is arranged to acknowledge the start of the transmission/reception of data by receiving an acknowledge signal sent from the corresponding memory chip 170 in response to the radio wave signal outputted from the radio communication portion 56, for example.

Figure 11:
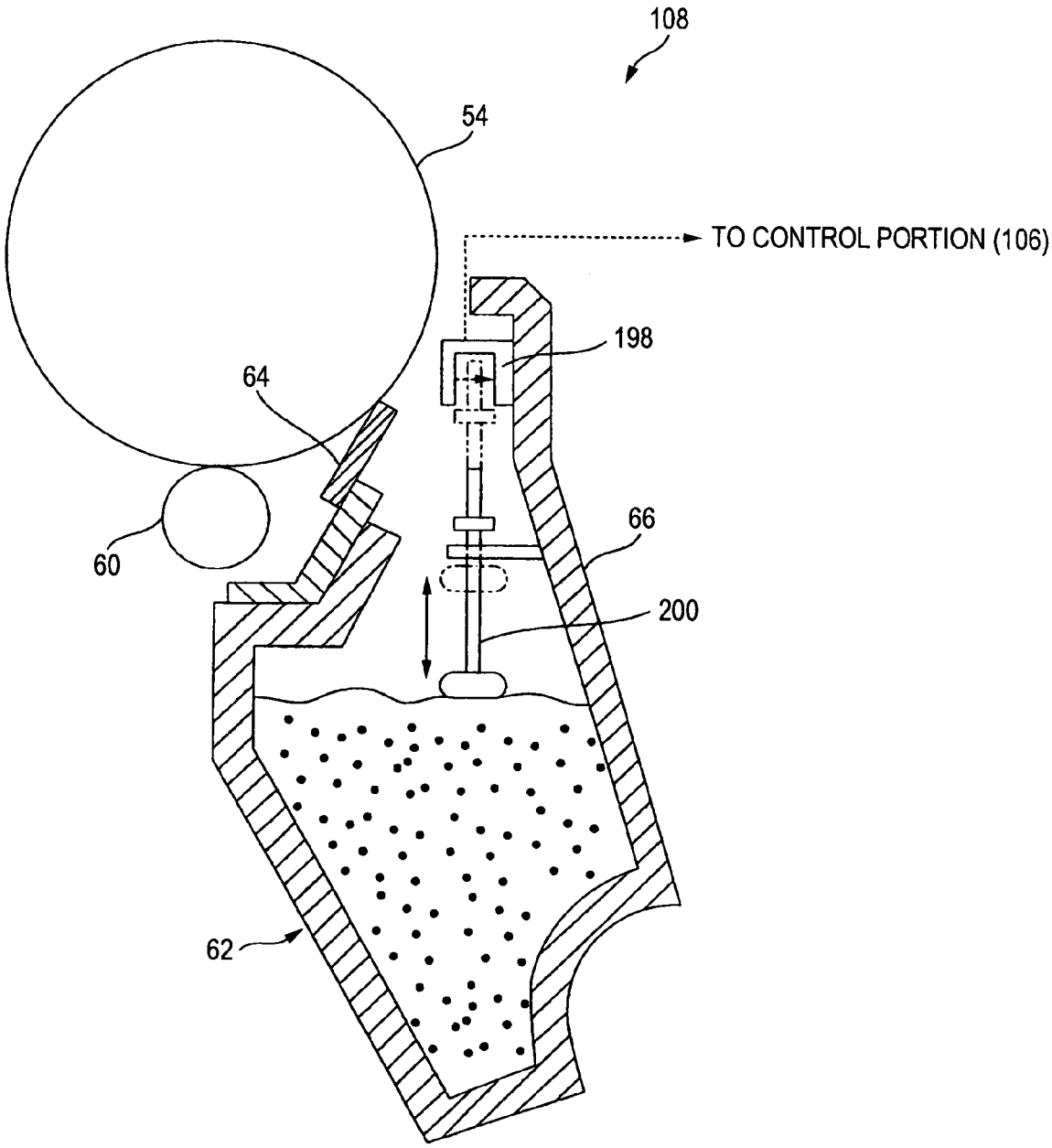
FIG. 11 is a side view showing the configuration of an image carrier unit used in the image forming device according to the embodiment of the invention.

FIG. 11 shows the configuration of the image carrier unit 108 which is a replacement unit.

As described above, the image carrier unit 108 is configured by integrating the image carrier 54, the charging device 60 and the image carrier cleaner 62. For example, the image carrier unit has a used toner full state sensor 198 provided at the upper portion within the image carrier cleaner 62 and a float 200 disposed beneath the used toner full state sensor 198. The used toner full state sensor 198 has an optical path which is arranged in a manner that light emitted from a light emitting portion provided on one side is received at a light receiving portion provided on the other side and outputs information as to whether or not the light receiving portion has received light to the control portion 106. The float 200 is arranged to move upward when used toner collected within the remaining toner collection bottle 66 from the image carrier 54 exceeds a predetermined amount and to shield the optical path of the used toner full state sensor 198 when the remaining toner collection bottle 66 is filled with used toner. In this manner, the image carrier unit 108 detects whether or not the remaining toner collection bottle 66 is filled with used toner by using the used toner full state sensor 198 and the float 200 and outputs the detection result to the control portion 106.

Alternatively, the used toner full state sensor 198 and the float 200 may be provided at the intermediate transfer member cleaner 92 thereby to detect whether or not the used toner collection bottle 98 is filled with used toner.

In this manner, the replacement unit having a sensor for detecting a predetermined condition etc. is arranged to output the result detected by the sensor etc. to the control portion 106, and the control portion 106 is arranged to control the respective portions constituting the image forming device 10 based on the detection result thus inputted.

Next, the configuration of the control portion 106 will be described in detail.

Figure 12:
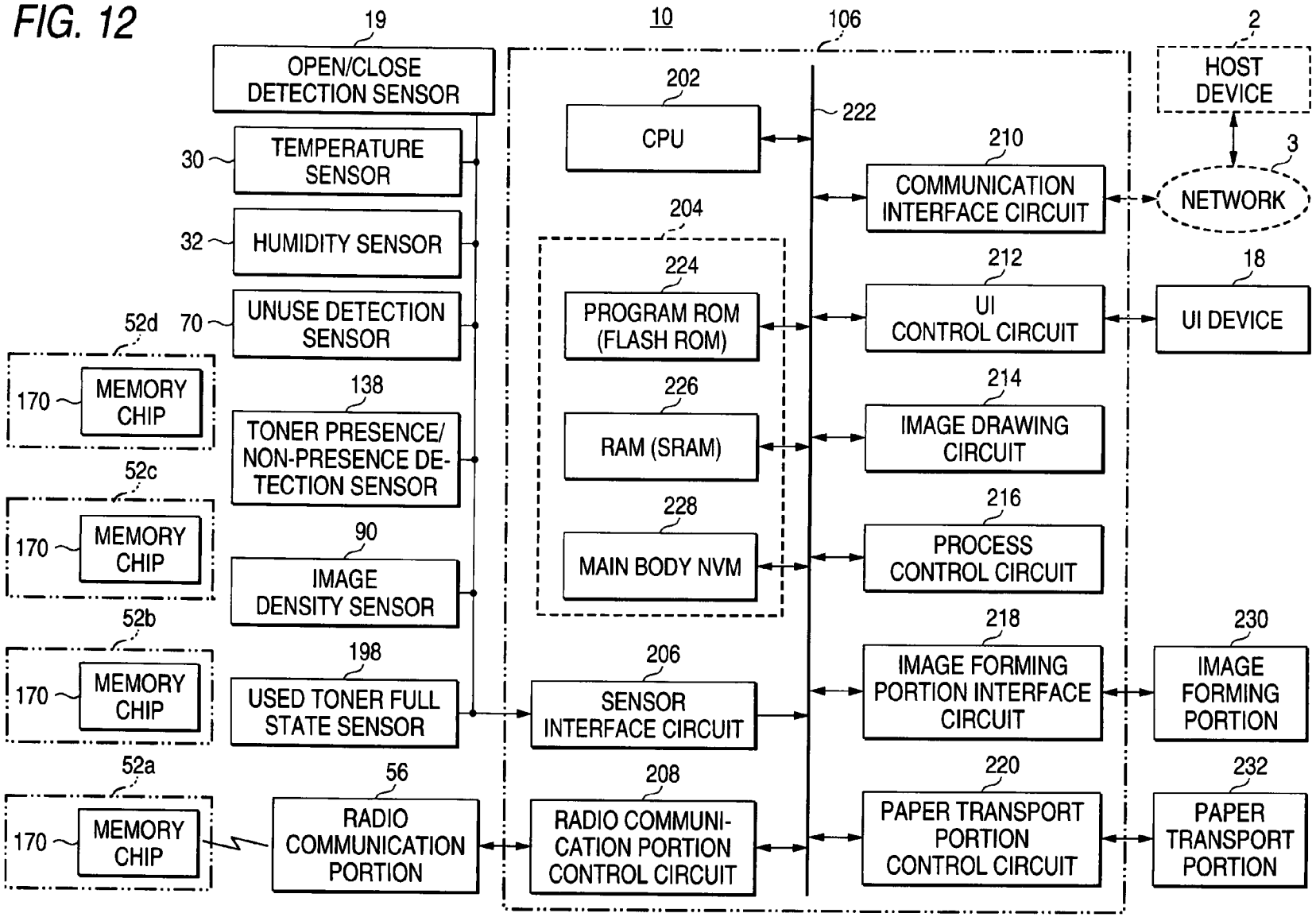
FIG. 12 is a block diagram showing the configuration of a control portion of the image forming device according to the embodiment of the invention and also showing respective portions coupled to the control portion.

FIG. 12 is a block diagram showing the configuration of the control portion 106 and respective portions connected to the control portion 106.

The control portion 106 has a CPU 202, a storage portion 204, a sensor interface (sensor I/F) circuit 206, a radio communication portion control circuit 208, a communication interface (communication I/F) circuit 210, a user interface (UI) control circuit 212, an image drawing circuit 214, a process control circuit 216, an image forming portion interface (image forming I/F) circuit 218 and a paper transport portion control circuit 220 etc. These constituent elements of the control portion are arranged to input/output a signal through a system bus 222.

The CPU 202 transmits a signal to and receives a signal from each of the portions constituting the control portion 106 through the system bus 222 thereby to control the respective portions constituting the control portion 106.

The storage portion 204 has a program ROM 224, a RAM 226 and a main body NVM (Non Volatile Memory) 228 and stores information necessary for the control of the image forming device 10 etc. The program ROM 224 may be configured by a flash ROM etc., for example, so that its storage contents can be updated. The RAM 226 is configured by a SRAM, for example, and stores temporal information such as drawing data inputted from the image drawing circuit 214. The main body NVM 228 is configured by an electrically rewritable nonvolatile memory such as an EEPROM or a flash ROM, for example. Incidentally, the main body NVM 228 may be a SRAM back-upped by a power supply such as a battery, a HDD (Hard Disk Drive) or an optical memory so long as it is a rewritable storage device which can hold data even when the power supply of the image forming device 10 is turned off.

The sensor I/F circuit 206 receives detection results from the open/close detection sensor 19, the temperature sensor 30, the humidity sensor 32, the unuse detection sensor 70, the toner presence/non-presence detection sensor 138, the image density sensor 90 and the used toner full state sensor 198 and outputs the detection results to the CPU 202 through the system bus 222. The radio communication portion control circuit 208 transmits signals to and receives signals from the four memory chips 170 respectively provided at the toner cartridges 52*a* to 52*d* through the radio communication portion 56, and also transmits signals to and receives signals from the CPU 202 and the storage portion 204 etc. through the system bus 222. The radio communication portion control circuit couples with the memory chips 170, the CPU 202 and the storage portion 204 etc.

The communication I/F circuit 210 transmits signals to and receives signals from the host device 2 through the network 3 and also transmits signals to and receives signals from the CPU 202 etc. through the system bus 222. The communication I/F circuit couples with the host device 2 and the CPU 202 etc. The UI control circuit 212 transmits signals to and receives signals from the UI device 18 and also transmits signals to and receives signals from the CPU 202 etc. through the system bus 222. The UI control circuit couples with the UI device 18, the CPU 202 etc.

The image drawing circuit 214 draws an image based on an image forming signal inputted from the host device 2 etc. and outputs the image to the CPU 202 and the RAM 226. The process control circuit 216 refers, together with the CPU 202, setting values etc. described later stored in the storage portion 204 and controls an image forming portion 230 having the exposure device 68, the image forming unit 110, the developing unit 44 etc. The paper transport portion control circuit 220 controls, together with the CPU 202, a paper transport portion 232 including the feed roller 26, the retard roller 28, the resist roller 38 etc.

The CPU 202 compares data stored in the storage portion 204 with data stored in the unit NVM 184 thereby to determine the state of the toner cartridge 52 attached to the memory chip 170, so that the memory chip 170 constitutes a part of the detection unit although the memory chip does not have a sensor.

Next, explanation will be made in detail as to data stored in the program ROM 224, the main body NVM 228 and the unit NVM 184.

Figure 13:
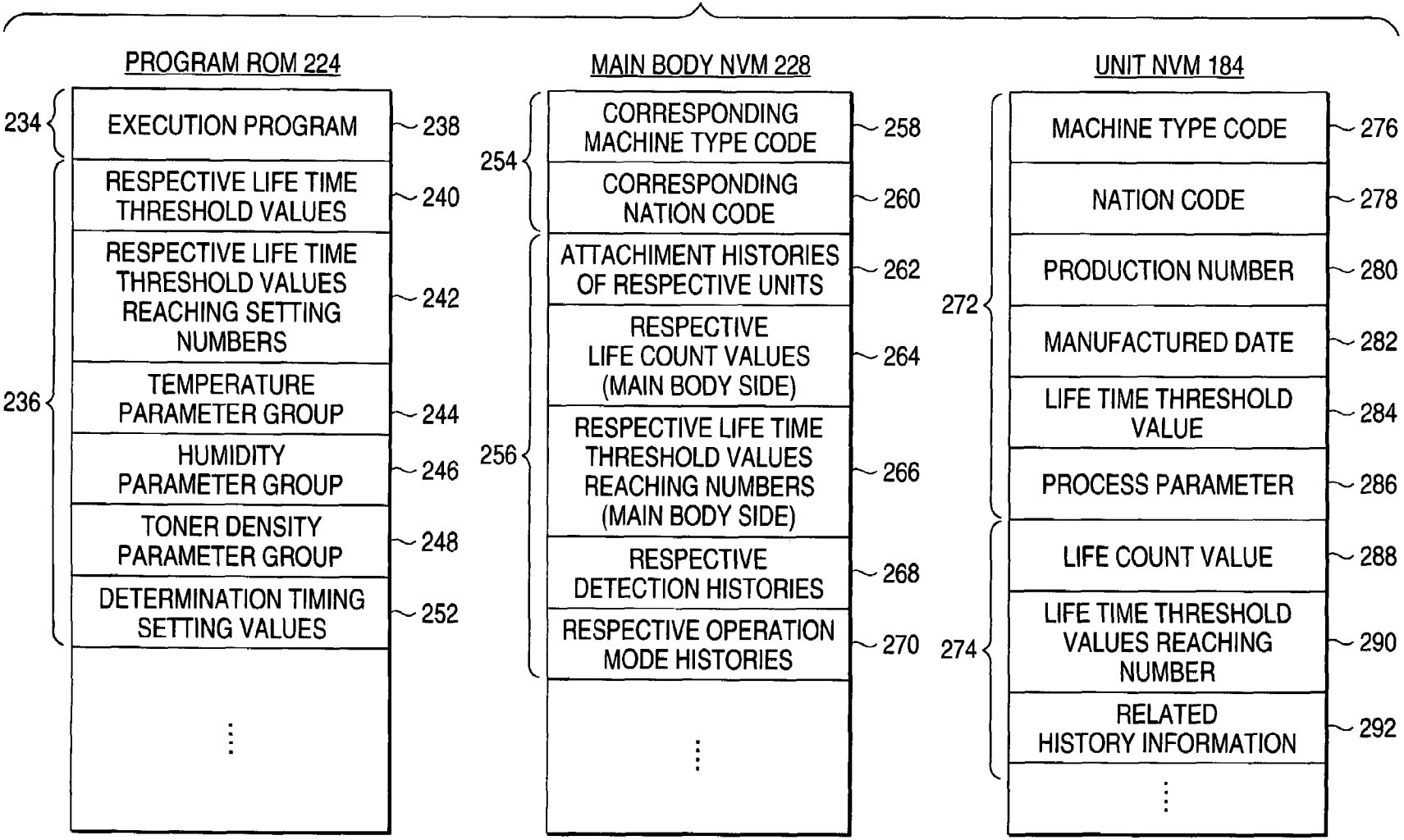
FIG. 13 is a diagram showing memory maps exemplarily showing data stored in a program ROM, a main body NVM and a unit NVM.

FIG. 13 shows an example of data stored in the program ROM 224, the main body NVM 228 and the unit NVM 184.

The program ROM 224 is provided with a program area 234, a setting value area 236 etc. The program area 234 stores an execution program 238 for operating the image forming device 10. The setting value area 236 stores respective life time threshold values 240, respective life time threshold values reaching setting numbers 242, a temperature parameter group 244, a humidity parameter group 246, a toner density parameter group 248, determination timing setting values 252 etc.

The life time threshold values 240 include life times (life time threshold values) of the respective replacement units of the image forming device 10. The life time threshold values reaching setting numbers 242 include the number of times by which the respective replacement units of the image forming device 10 are allowed to reach the life time threshold values thereof, respectively. The temperature parameter group 244 includes respective parameters relating to the control for the temperature of the image forming device 10. The humidity parameter group 246 includes respective parameters relating to the control for the humidity of the image forming device 10. The toner density parameter group 248 includes respective parameters relating to the control for the toner density within the developers 48. The determination timing setting values 252 include time periods (determination timings) at which the CPU 202 starts the determination as to whether the respective replacement units of the image forming device 10 are genuine type units or not in the processing such as the printing preparation (FIG. 15) etc. matched to the operation mode performed by the image forming device 10.

The main body NVM 228 is provided with a corresponding unit information area 254, a main body side update area 256 etc.

The corresponding unit information area 254 stores a corresponding machine type code 258 and a corresponding nation code 260. The corresponding machine type code 258 stores a table (data) of machine types which represents the machine types fitting to the image forming device 10 as to the respective replacement units of the image forming device 10. The corresponding nation code 260 stores a table (data) of nations which represents that different specifications are set to respective nations as to each of the respective replacement units of the image forming device 10.

The main body side update area 256 stores attachment histories 262 of the respective units, respective life count values 264 on the main body side, respective life time threshold values reaching numbers 266 on the main body side, respective detection histories 268, respective operation mode histories 270 etc. The respective unit attachment histories 262 include attachment histories of the respective replacement units of the image forming device 10. The attachment histories 262 store data that genuine type units are attached as initial states (initial values). The respective life count values 264 on the main body side include life count values (used amounts from the start of usage to the current time point) of the respective replacement units of the image forming device 10. In this respect, the used amount of the each unit may be calculated from the accumulated operation times of the each unit etc. The respective life time threshold values reaching numbers 266 on the main body side include the life time threshold value reaching number of times of each of the respective replacement units of the image forming device 10. The respective detection histories 268 include histories of detection results detected by the sensors provided at the image forming device 10. The respective operation mode histories 270 include the histories of the operation modes having been applied to the respective replacement units of the image forming device 10. The respective operation mode histories 270 are updated (including the overwriting) when the operation mode is changed and stores an operation mode at the time of the turning-off of the power supply for the apparatus main body even when the power supply for the apparatus main body is turned off.

The unit NVM 184 is provided with a unit information area 272, a unit side update area 274 etc.

The unit information area 272 stores a machine type code 276 representing the machine type, a nation code 278 representing a nation(s) as to which the specification is designated, a production number 280 peculiar to the unit, a manufactured date 282, a lifetime threshold value 284 representing the life time of the unit, a process parameter 286 for the process control etc.

The unit side update area 274 stores a life count value 288 representing the used amount of the toner cartridge 52 from the start of the usage to the current time, a life time threshold values reaching number 290 representing the number of times by which the unit has reached the life time threshold value, related history information 292 etc. The related history information 292 includes the history of the related information such as the rotation speed of the image carrier 54 usable for grasping the state of the toner cartridge 52.

When an image forming signal is transmitted to the image forming device 10 thus configured, the image carrier 54 is charged uniformly by the charging device 60 and a light beam is irradiated on the image carrier 54 thus charged from the exposure device 68 based on an image signal. The light beam from the exposure device 68 exposes the surface of the image carrier 54 to form a latent image.

The latent image thus carried by the image carrier 54 is developed by the developing unit 44 at the developing position. In the developing unit 44, the developers 48*a* to 48*d* are supplied with toners of yellow, magenta, cyan and black from the toner cartridges 52*a* to 52*d*, respectively. The developing agent having been excessively supplied to the developers 48*a* to 48*d* is collected by the toner cartridges 52*a* to 52*d*, respectively. The toner images developed with the respective colors by the developers 48*a* to 48*d* of the developing unit 44 are primarily-transferred on the intermediate transfer member 74 in a superimposed manner. In the primary transfer, the used toner remained on the image carrier 54 is scraped and collected by the image carrier cleaner 62.

On the other hand, sheets of paper housed within the paper feed cassette 24 are sequentially sent out by the feed roller 26 in accordance with a paper feed signal etc., then treated by the retard roller 28 and introduced to the transport path 34, then temporarily stopped by the resist roller 38 and introduced into a gap between the secondary transfer roller 88 and the secondary transfer backup roller 82 at a suitable timing. When a sheet of paper is introduced into a gap between the secondary transfer roller 88 and the secondary transfer backup roller 82, the toner image of four colors having been superimposed on the intermediate transfer member 74 by the primary transfer is secondarily transferred on a sheet of paper by the secondary transfer roller 88 and the secondary transfer backup roller 82. After the secondary transfer, the used toner remained on the intermediate transfer member 74 is scraped and collected by the intermediate transfer member cleaner 92.

The sheet of paper thus transferred with a toner image is introduced into the fusing device 100 and the toner image is fixed on the sheet of paper by the thermal pressure between the heat roller 102 and the pressure roller 104. The sheet of paper thus fixed with the toner image is ejected to the ejection portion 42 from the ejection port 36 by the ejection roller 40. The control portion 106 stores the life count values etc. of the toner cartridges 52 in the unit NVM 184 and the main body NVM 228.

Figure 14:
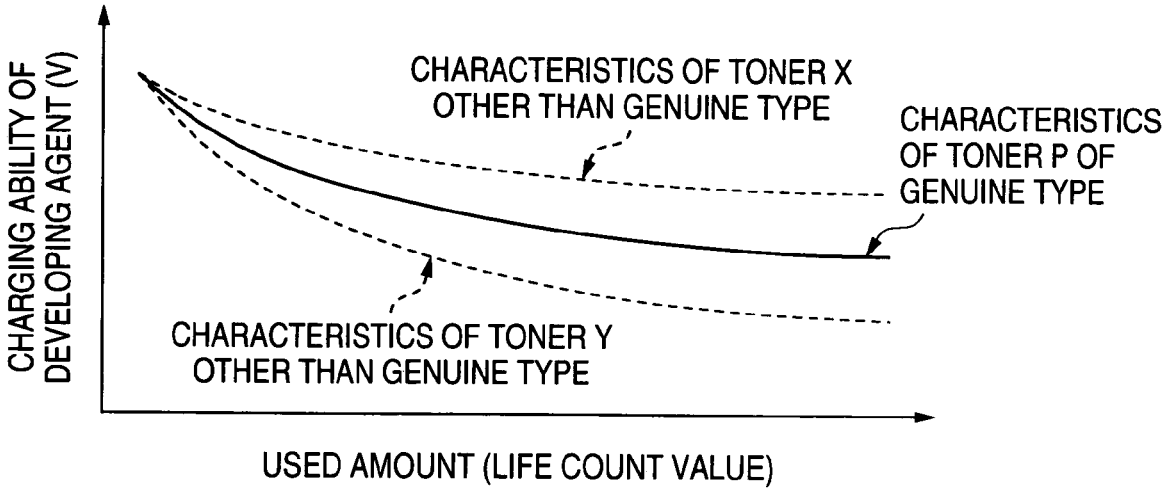
FIG. 14 is a graph showing changes of charging ability of developing agent with respect to a used amount of the developing agent (life count value) stored in the main body NVM.

FIG. 14 is a graph showing changes of charging ability of the developing agent with respect to the used amount of the developing agent (life count value) stored in the main body NVM 228.

Figure 15:
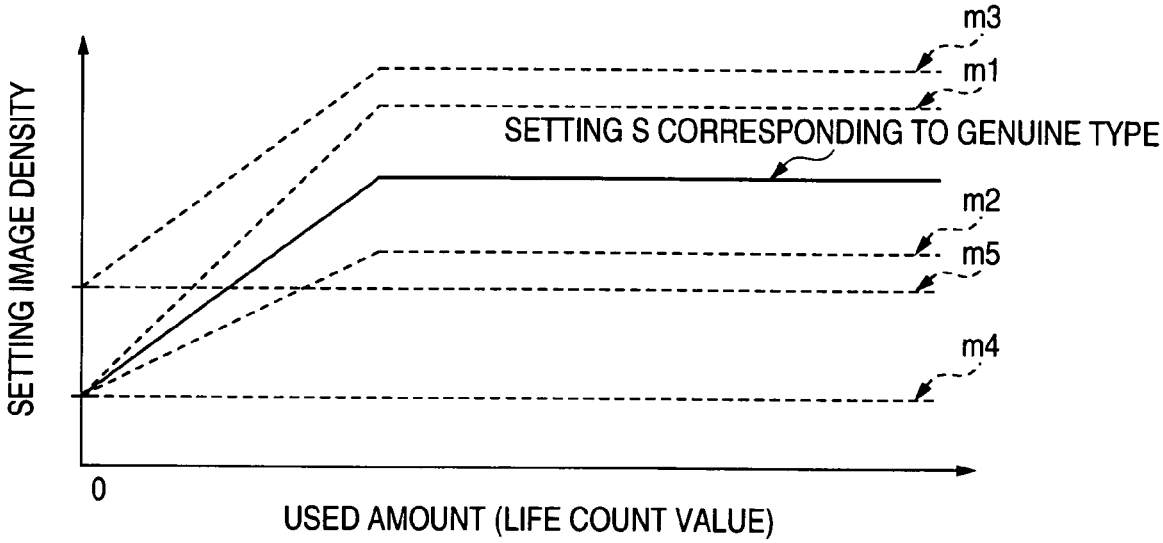
FIG. 15 is a graph showing the setting for correcting the changes of the charging ability of the developing agent and also showing the setting of an image density with respect to the used amount of the developing agent.

FIG. 15 is a graph showing the setting for correcting the changes of the charging ability of the developing agent and also showing the setting of an image density with respect to the used amount of the developing agent.

Figure 16A:
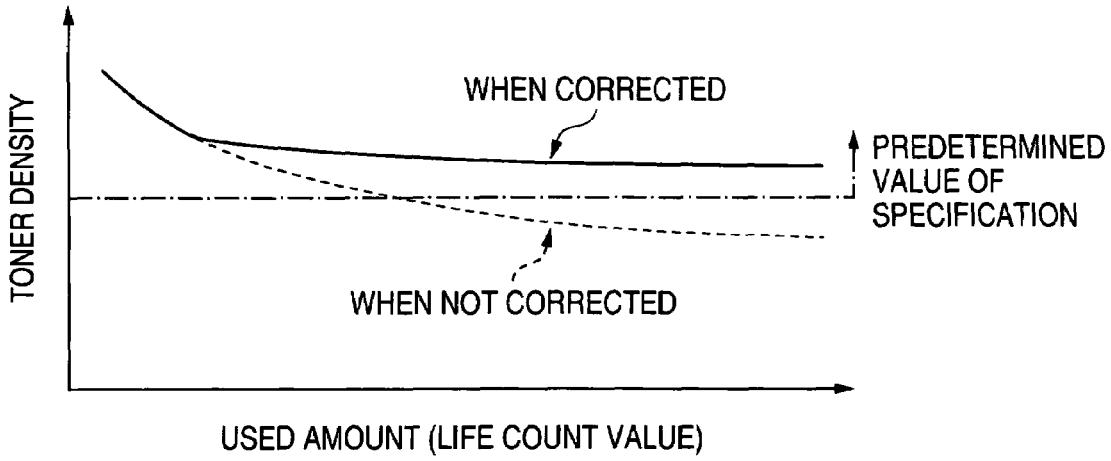
Figure 16B:
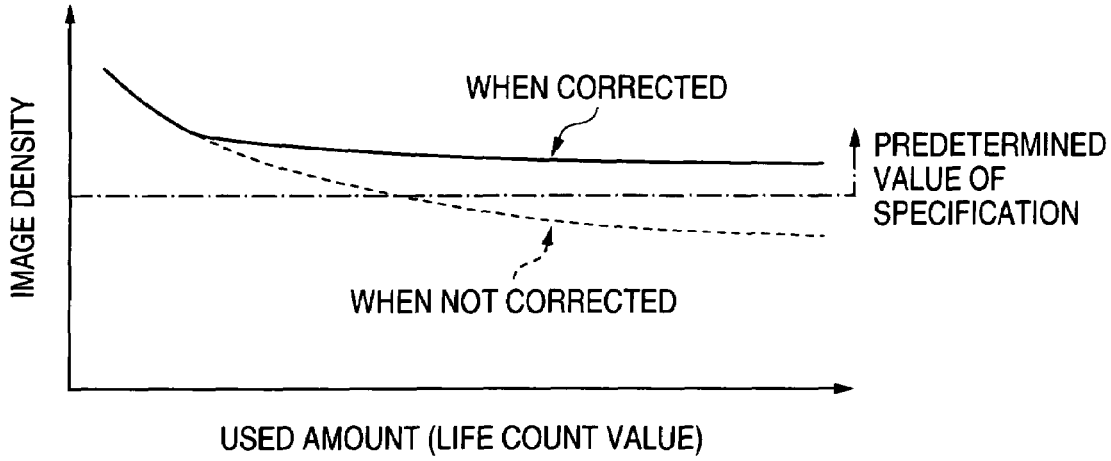

FIGS. 16A and 16B are graphs showing the results corrected by the setting shown in FIG. 15, wherein FIG. 16A shows the corrected toner density and FIG. 16B is a graph showing the corrected image density.

Toner housed within the toner cartridge 52 is rubbed and charged to the predetermined charging amount of the predetermined polarity by carrier within the developer 48. When the developing agent is used, the charging ability of the developing agent degrades in accordance with the used amount of the developing agent like the characteristics of toner P of genuine type shown in FIG. 14.

Thus, even if the trickle developing method is employed, the image forming device 10 is arranged to correct the setting of the toner density within the developer 48 and the setting of the image density on the intermediate transfer member 74 in order to maintain the image quality of an image formed on a sheet of paper to a predetermined level.

For example, when the image density detected by the image density sensor 90 is high, the CPU 202 controls the rotation of the first auger 118 to reduce an amount of toner supplied within the developer 48 to reduce the toner density thereby to reduce the image density. In contrast, when the image density is low, the CPU controls the rotation of the first auger 118 to increase an amount of toner supplied within the developer 48 to increase the toner density thereby to increase the image density. Usually, a pattern having a halftone density is used as the pattern for detecting the image density.

However, when the charging ability of toner is degraded, the developing efficiency is improved and so the image density increases. Thus, if the control is executed in this state, the toner density is too reduced thereby to reduce the maximum image density.

In view of this matter, the setting value for the density control of toner within the developer 48 stored in the toner density parameter group 248 used for the toner density control based on the image density detection result by the image density sensor 90 is corrected so as to be increased in accordance with the used amount of the developing agent so that the maximum image density of an image to be transferred on a sheet of paper does not reduce even if the charging ability of the developing agent reduces. The CPU 202 rotates the first auger 118 in accordance with the corrected setting value (the setting S corresponding to the toner P in FIG. 15) thereby to maintain the toner density so that the toner density does not reduce to the desired predetermined value or less as shown in FIG. 16A.

As a result, the image density can be maintained so as not to be below the predetermined value of the specification as shown in FIG. 16B.

On the other hand, when a toner cartridge other than a genuine type is attached which has almost the same configuration as the toner cartridge 52 housing toner X or toner Y that is other than a genuine type for the image forming device 10, the toner is expected to exhibit the characteristics different from that of the toner P of genuine type shown in FIG. 14. Thus, it is necessary to provide a corrected setting value different from the setting S corresponding to the toner P in order to improve the image quality of an image formed on a sheet of paper. Therefore, for example, when a toner cartridge is other than a genuine type which houses the toner X or toner Y, the correction for the using amount of the developing agent is modified in combination of such correction conditions as the decrease or increase of the changing amount (inclination) of the setting value of the toner density (m1, m2 in FIG. 15), the decrease or increase of the limiting value (m1, m2), the changing of the initial value (using amount=0) (m3), not-changing the setting value in accordance with the using amount (m4) and not-changing the setting value in accordance with the using amount by changing the initial value, for example (m5). This modification is performed in a manner that a user selects through the UI device 18 an operation mode different from the operation mode corresponding to a genuine type toner cartridge.

Next, the explanation will be made as to the control of the image forming device 10 based on the data stored in the storage portion 204 and the unit NVM 184.

The image forming device 10 controls the display performed by the UI device 18 etc. based on the data stored in the storage portion 204 and the unit NVM 184. For example, when the toner cartridge 52 is a genuine type, the UI device 18 displays a remaining amount of toner under the control of the CPU 202, whilst a used amount of toner is displayed when the toner cartridge 52 is one other than the genuine type. This is because, when the toner cartridge is one other than the genuine type, a remaining amount of toner can not be calculated since the total amount of toner is not known.

Next, the explanation will be made as to the control method when the power supply of the image forming device 10 is turned on.

Figure 17:
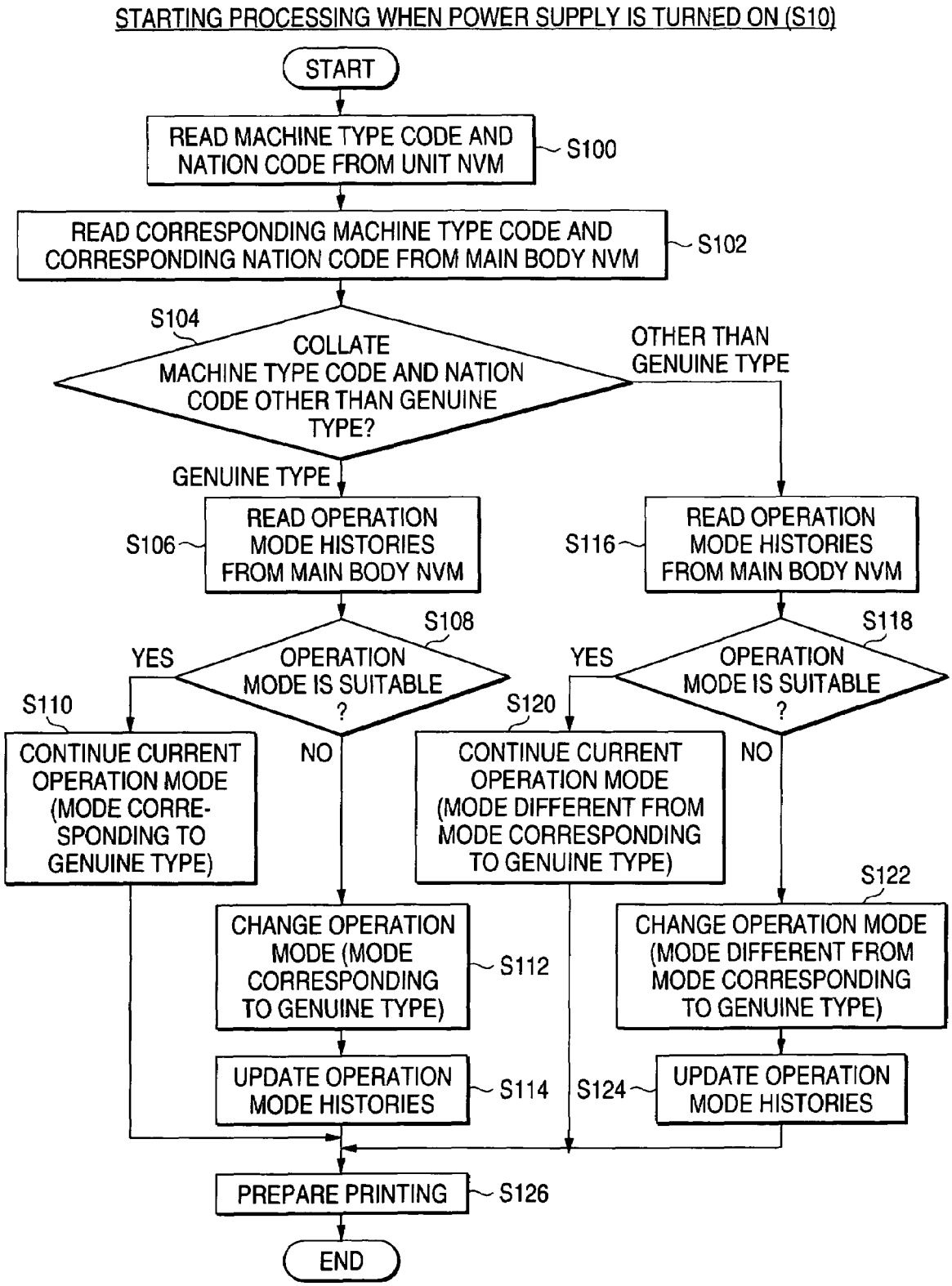
FIG. 17 is a flowchart (S10) showing a starting processing in which the image forming device performs the preparation of the printing operation in accordance with an operation mode in the case where the power supply of the image forming device is turned on after the toner cartridge is exchanged during the turning-off state of the power supply.

FIG. 17 is a flowchart (S10) showing a starting processing in which the image forming device 10 performs the preparation of the printing operation in accordance with an operation mode in the case where the power supply of the image forming device 10 is turned on after the toner cartridge 52 is exchanged during the turning-off state of the power supply. As shown in FIG. 17, in step 100 (S100), when the power supply of the image forming device 10 is turned on, the CPU 202 reads the machine type code 276 and the nation code 278 from the unit NVM 184.

In step 102 (S102), the CPU 202 reads the corresponding machine type code 258 and the corresponding nation code 260 from the main body NVM 228.

In step 104 (S104), the CPU 202 collates the machine type code 276 with the corresponding machine type code 258 and also collates the nation code 278 with the corresponding nation code 260. When it is determined that the toner cartridge 52 thus exchanged is the genuine type, the process proceeds to step S106, whilst the process proceeds to step S116 when it is determined that the toner cartridge 52 thus exchanged is one other than the genuine type.

In step 106 (S106), the CPU 202 reads the respective operation mode histories 270 from the main body NVM 228 and specifies the operation mode just before the turning-off of the power supply.

In step 108 (S108), the CPU 202 compares the operation mode read from the main body NVM 228 with the operation mode corresponding to the genuine type. When the operation mode read from the main body NVM 228 is the operation mode corresponding to the genuine type, the process proceeds to step S110, whilst the process proceeds to step S112 when the operation mode read from the main body NVM 228 is the operation mode different from the operation mode corresponding to the genuine type.

In step 110 (S110), the CPU 202 continues to control the image forming device 10 with the operation mode read from the main body NVM 228, that is, the operation mode just before the turning-off of the power supply, and the process proceeds to step S126.

In step 112 (S112), the CPU 202 changes the operation mode into that corresponding to the genuine type and controls the image forming device 10 with the operation mode corresponding to the genuine type.

In step 114 (S114), the CPU 202 updates (including overwriting) the respective operation mode histories 270 of the main body NVM 228 thereby to store that the operation mode has been changed from the operation mode different from the operation mode corresponding to the genuine type to the operation mode corresponding to the genuine type, and the process proceeds to step S126.

In step 116 (S116), the CPU 202 reads the respective operation mode histories 270 from the main body NVM 228 and specifies the operation mode just before the turning-off of the power supply.

In step 118 (S118), the CPU 202 compares the operation mode read from the main body NVM 228 with the operation mode different from the operation mode corresponding to the genuine type. When the operation mode read from the main body NVM 228 is the operation mode different from the operation mode corresponding to the genuine type, the process proceeds to step S120, whilst the process proceeds to step S122 when the operation mode read from the main body NVM 228 is the operation mode corresponding to the genuine type.

In step 120 (S120), the CPU 202 continues to control the image forming device 10 with the operation mode read from the main body NVM 228, that is, the operation mode just before the turning-off of the power supply, and the process proceeds to step S126.

In step 122 (S122), the CPU 202 changes the operation mode into the operation mode different from that corresponding to the genuine type and controls the image forming device 10 with the operation mode different from that corresponding to the genuine type.

In step 124 (S124), the CPU 202 updates (including overwriting) the respective operation mode histories 270 of the main body NVM 228 thereby to store that the operation mode has been changed from the operation mode corresponding to the genuine type to the operation mode different from the operation mode corresponding to the genuine type, and the process proceeds to step S126.

In step 126 (S126), the CPU 202 performs the preparation of the printing operation matching to the selected operation mode contained in the newest respective operation mode histories 270 and terminates the processing. Incidentally, in the preparation of the printing operation in step S118, the fact whether the toner cartridge 52 being attached is a genuine type or not may be displayed, for example.

In this manner, when the replacement unit is attached in a state where the power supply of the device main body is turned off, the operation mode corresponding to the replacement unit having been attached is selected when the power supply is turned on, the image quality can be improved even when the replacement unit having been attached is different from the replacement unit attached just before the turning-off of the power supply.

Next, the explanation will be made as to a modified example of the image forming device according to the embodiment of the invention. The modified example of the image forming device is arranged in a manner that the operation mode just before the turning-off of the power supply is compared with the operation mode corresponding to a replacement unit having been attached in a state that the power supply of the device main body is turned off. When the operation modes thus compared are different to each other, the comparison result is displayed on the UI device 18 and the image forming device is controlled by an operation mode selected by a user.

Figure 18:
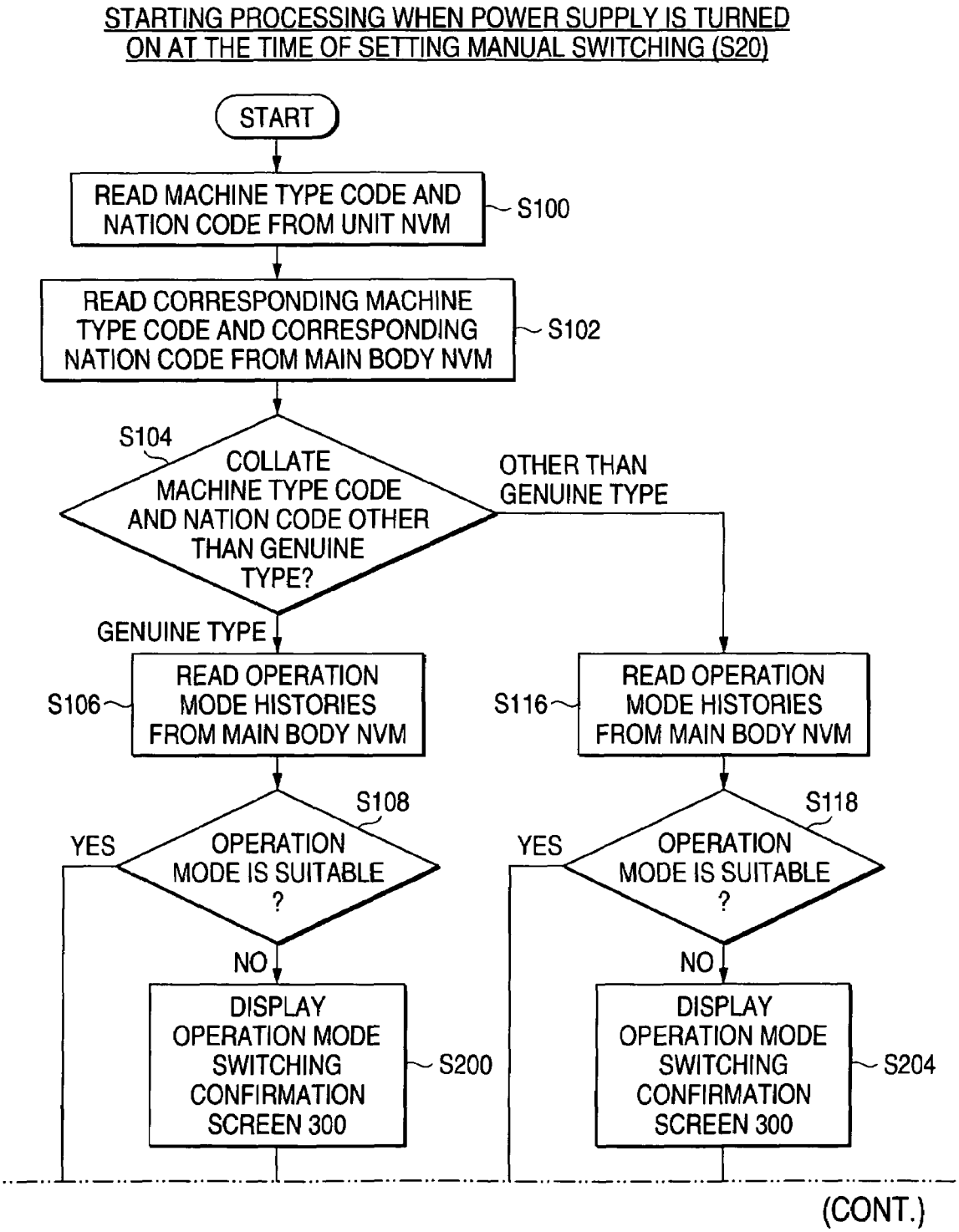
FIG. 18 is a flowchart (S20) showing a starting processing in which the image forming device performs the preparation of the printing operation in accordance with an operation mode selected by a user in the case where the power supply of the image forming device is turned on after the toner cartridge is exchanged during the turning-off state of the power supply.

FIG. 18 is a flowchart (S20) showing a starting processing in which the image forming device 10 performs the preparation of the printing operation in accordance with an operation mode selected by a user in the case where the power supply of the image forming device 10 is turned on after the toner cartridge 52 is exchanged during the turning-off state of the power supply. In the processings S20 shown in FIG. 18, processings substantially same as those of the processings S10 shown in FIG. 17 are referred to by the common symbols.

As shown in FIG. 18, in step 108 (S108), the CPU 202 compares the operation mode read from the main body NVM 228 with the operation mode corresponding to the genuine type. When the operation mode read from the main body NVM is the operation mode corresponding to the genuine type, the process proceeds to step S110, whilst the process proceeds to step S112 when the operation mode read from the main body NVM 228 is the operation mode different from the operation mode corresponding to the genuine type.

Figure 20A:
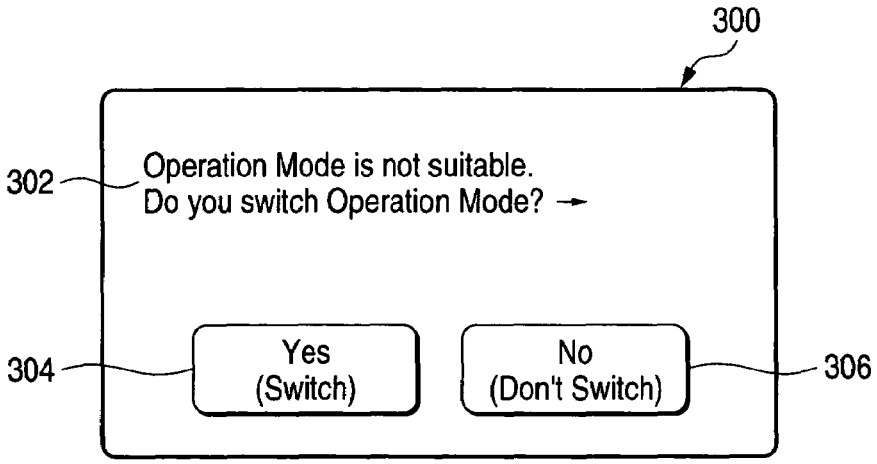

In step 200 (S200), the CPU 202 displays a switching confirmation screen 300 illustrated in FIG. 20A on the UI device 18. The switching confirmation screen 300 includes a confirmation message 302 for making a user confirm that the operation mode is to be switched, an YES button 304 for selecting that a user switches the operation mode after the user recognizes the switching of the operation mode, and a NO button 306 for selecting that a user does not switch the operation mode.

In step 202 (S202), the CPU 202 discriminates whether the YES button 304 or the NO button 306 is pushed among the buttons displayed on the switching confirmation screen 300 shown in FIG. 20A. When the YES button 304 is pushed, the process proceeds to step S112, whilst the process proceeds to step S120 when the NO button 306 is pushed. That is, when the NO button 306 is pushed, the CPU 202 controls the image forming device 10 with the operation mode different from the operation mode corresponding to the genuine type despite that the toner cartridge 52 having been exchanged is the genuine type.

In step 204 (S204), the CPU 202 displays the switching confirmation screen 300 illustrated in FIG. 20A on the UI device 18 like the processing of step S200.

In step 206 (S206), the CPU 202 discriminates whether the YES button 304 or the NO button 306 is pushed among the buttons displayed on the switching confirmation screen 300 shown in FIG. 20A. When the YES button 304 is pushed, the process proceeds to step S122, whilst the process proceeds to step S208 when the NO button 306 is pushed.

Figure 20B:
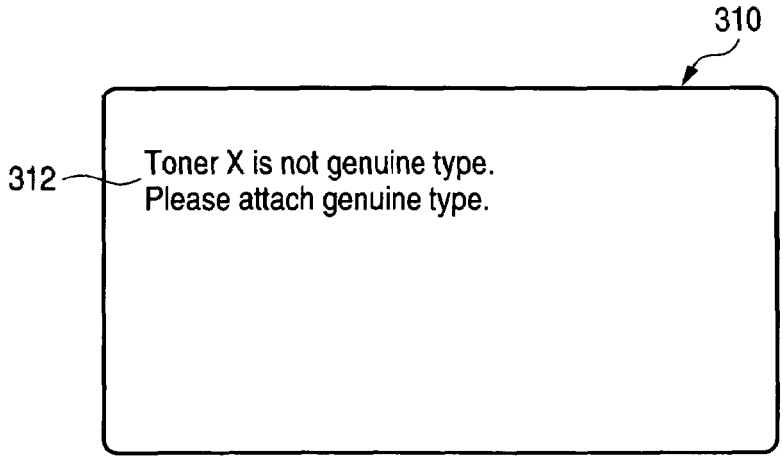

In step 208 (S208), the CPU 202 displays a replacement request screen 310 illustrated in FIG. 20B on the UI device 18. The replacement request screen 310 includes a request message 312 for requesting a user to exchange a genuine-type toner cartridge for the toner cartridge 52 having been attached. The replacement request screen 310 is displayed when a user does not admit to switch the operation mode into the operation mode different from the operation mode corresponding to the genuine type despite that the toner cartridge 52 having been attached in the state where the power supply is turned off is other than the genuine type. In this case, since the preparation of the printing operation in step S126 is not performed, a user is required to exchange the genuine-type toner cartridge for the toner cartridge 52 having been attached.

A user can select an automatic switching where the operation mode is switched automatically when the power supply is turned on or a manual switching where the operation mode is switched manually and the confirmation procedure of a user is also performed manually.

Figure 19:
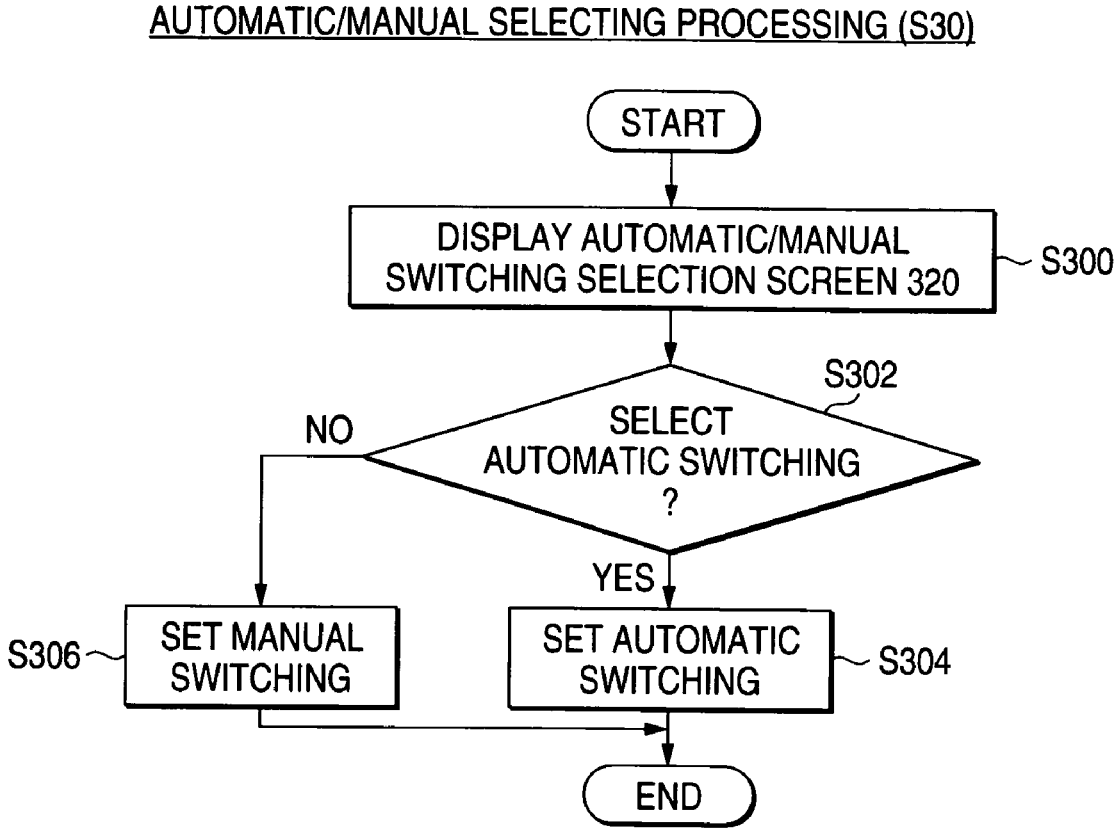
FIG. 19 is a flowchart (S30) showing an automatic/manual selecting processing performed by the image forming device in order for a user to select the automatic switching of the operation mode or the manual switching of the operation mode.

FIG. 19 is a flowchart (S30) showing an automatic/manual selecting processing performed by the image forming device in order for a user to select the automatic switching of the operation mode or the manual switching of the operation mode.

Figure 20C:
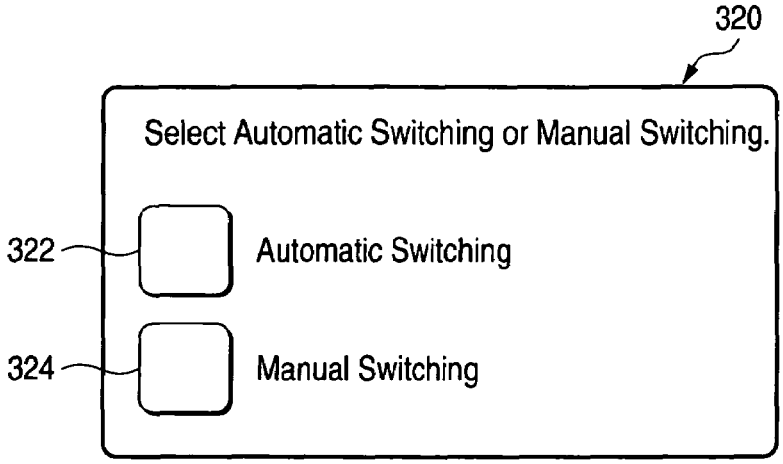

When a user operates the UI device 18 to input data for staring the selection of the automatic switching or the manual switching, the process proceeds to step 300 (S300 of FIG. 19). In this step, as shown in FIG. 20C, the UI device 18 displays a switching selection screen 320 including an automatic switching button 322 for selecting that the image forming device 10 is controlled so as to automatically switch the operation mode upon turning-on of the power supply and a manual switching button 324 for selecting that the image forming device 10 is controlled so as to manually switch the operation mode and also manually perform the confirmation procedure of a user upon turning-on of the power supply.

In step 302 (S302), the CPU 202 discriminates whether or not the automatic switching button 322 displayed on the switching selection screen 320 is selected. When the automatic switching button 322 is selected, the process proceeds to step S304, whilst the process proceeds to step S306 when the manual switching button 324 is selected.

In step 304 (S304), the CPU 202 sets the operation so that the operation mode is switched automatically when the power supply is turned on.

In step 306 (S306), the CPU 202 sets the operation so that the operation mode is switched manually and also the confirmation procedure of a user is performed manually when the power supply is turned on.

In the aforesaid embodiment, although the display unit for displaying the status of the replacement unit upon turning-on of the power supply is provided at the image forming device 10, the display unit may be provided at the host device 2 as another embodiment. Further, although in the aforesaid embodiment, the input unit for selecting the operation mode is provided at the image forming device 10, the input unit may be provided at the host device 2 as another embodiment.

Second Embodiment

An image forming apparatus of the second embodiment includes configurations of the first embodiment that are explained by FIGS. 1 to 20. Therefore, in this embodiment, explanations of the overlapped configurations are omitted.

Figure 21:
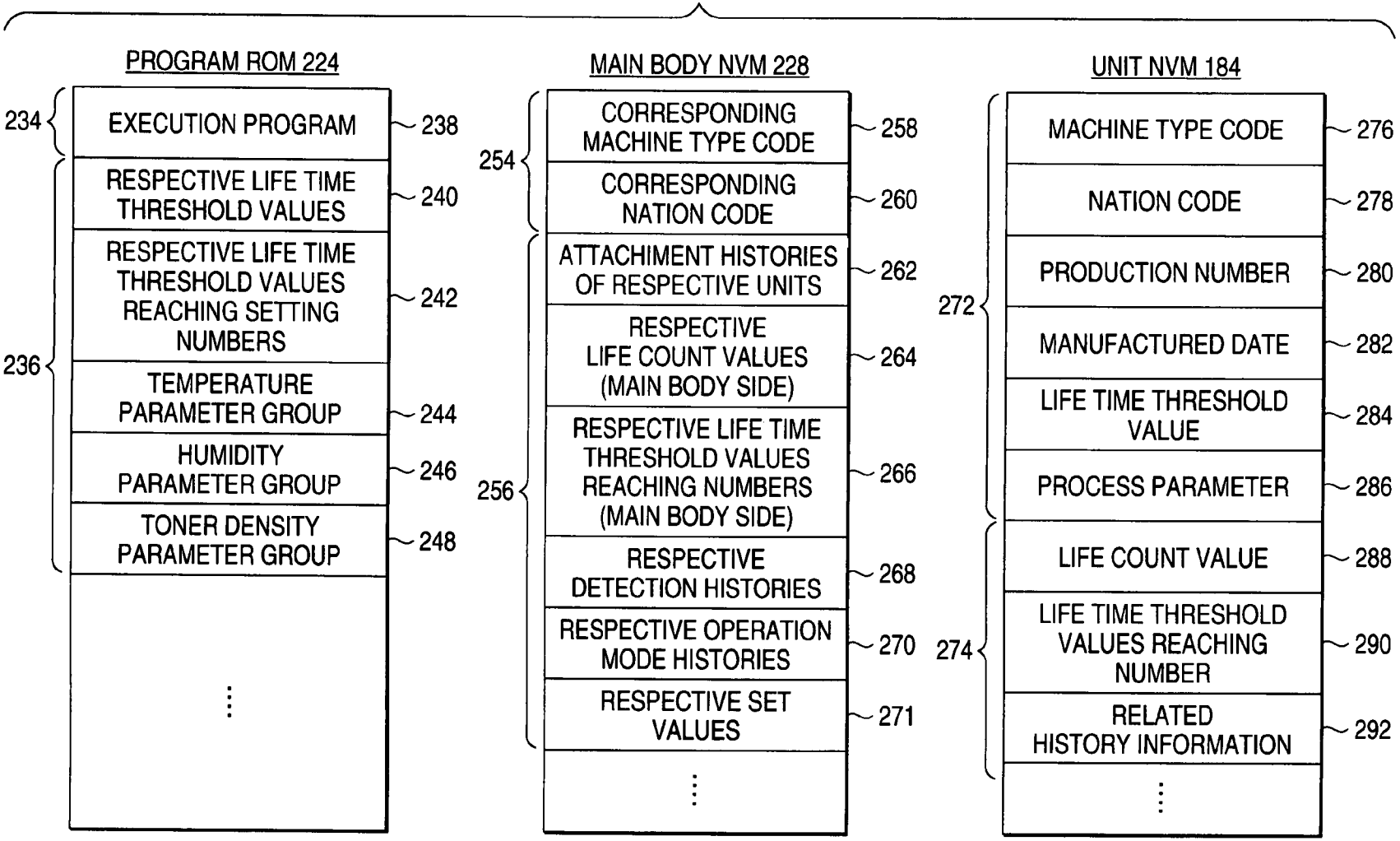
FIG. 21 is a diagram showing memory maps exemplarily showing data stored in a program ROM, a main body NVM and a unit NVM.

FIG. 21 is a diagram showing memory maps exemplarily showing data stored in a program ROM, a main body NVM and a unit NVM.

The explanation will be made as to the printing operation preparing processing for the toner cartridge 52 performed by the image forming device 10 in accordance with the operation mode.

Figure 22:
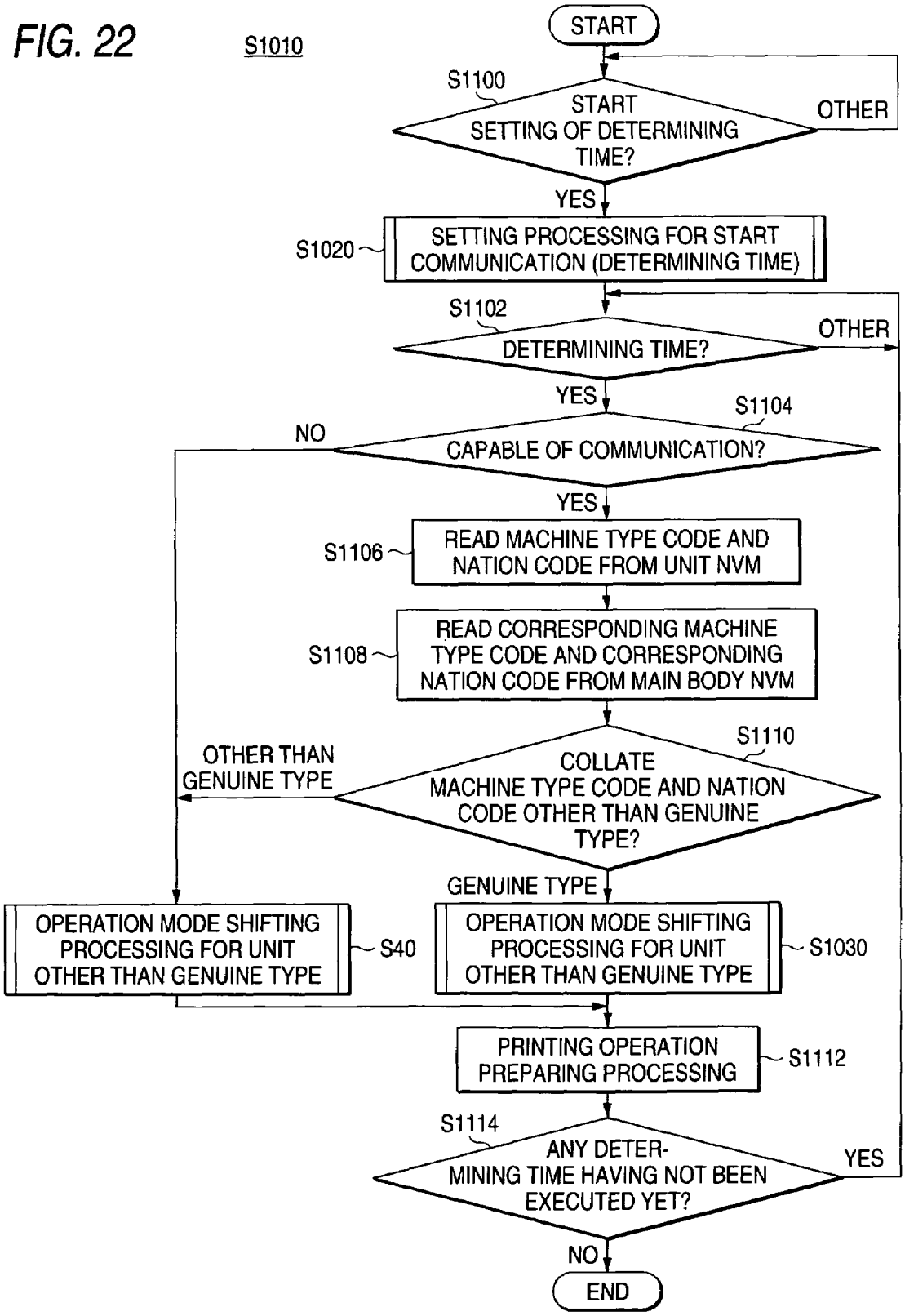
FIG. 22 is a flowchart (S1010) showing the printing operation preparing processing for the toner cartridge performed by the image forming device in accordance with the operation mode.

FIG. 22 is a flowchart (S1010) showing the printing operation preparing processing for the toner cartridge 52 performed by the image forming device 10 in accordance with the operation mode.

Figure 23:
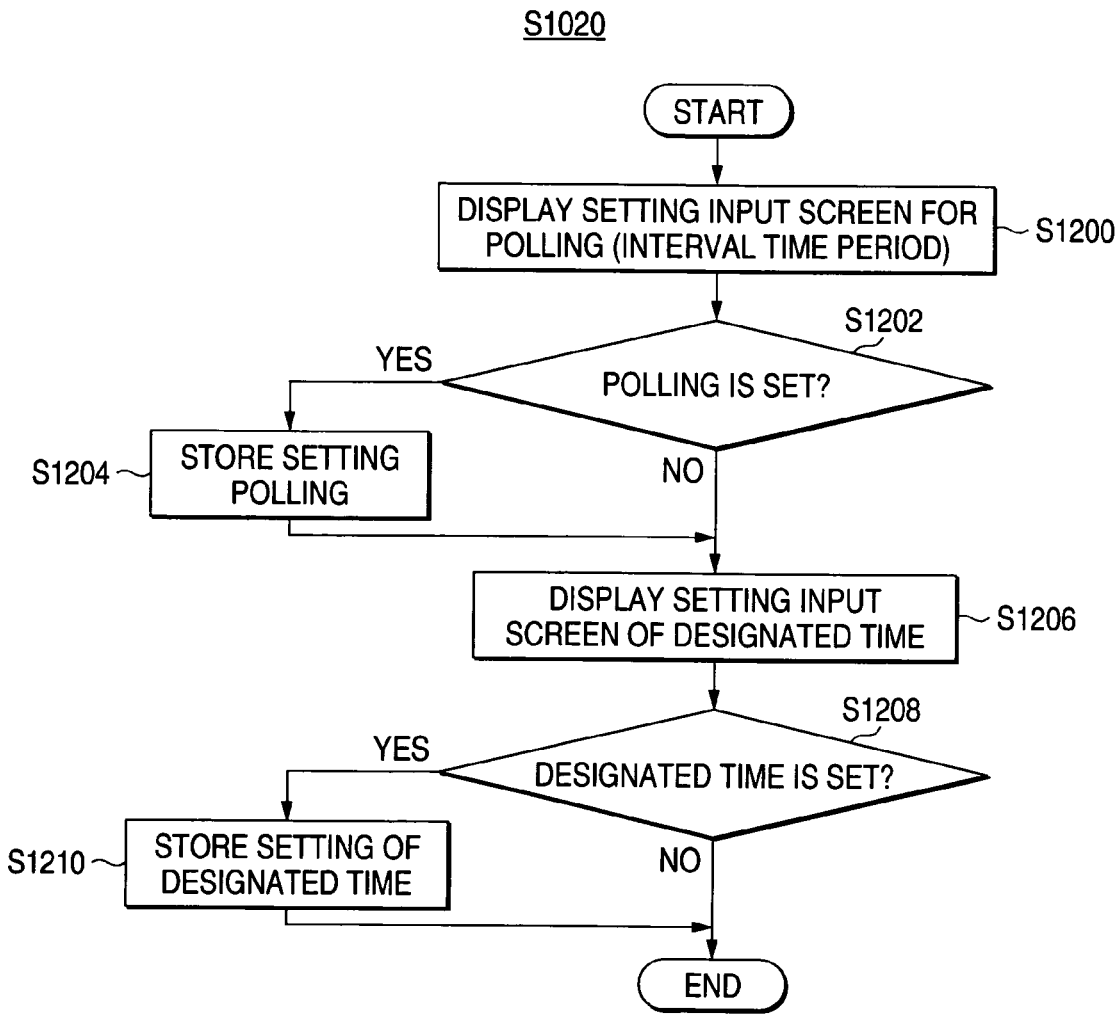
FIG. 23 is a flowchart (S1020) showing the processing for setting the start of the communication (determining time) performed by the control portion in accordance with the input of a user.

FIG. 23 is a flowchart (S1020) showing the processing for setting the start of the communication (determining time) performed by the control portion 106 in accordance with the input of a user.

Figure 24:
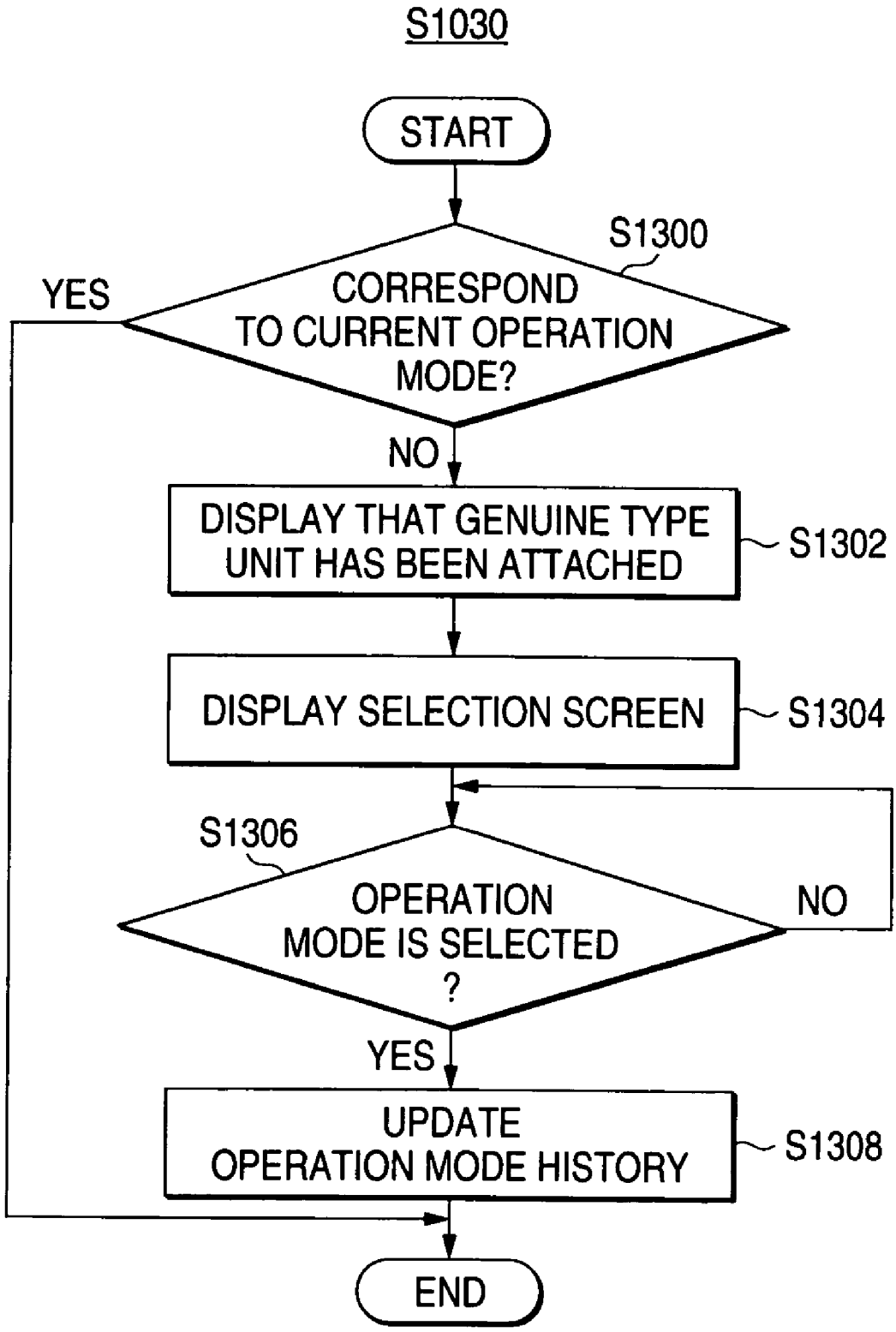
FIG. 24 is a flowchart (S1030) showing the operation mode shifting processing for a genuine type unit performed by the image forming device.

FIG. 24 is a flowchart (S1030) showing the operation mode shifting processing for the genuine type unit performed by the image forming device 10.

Figure 25:
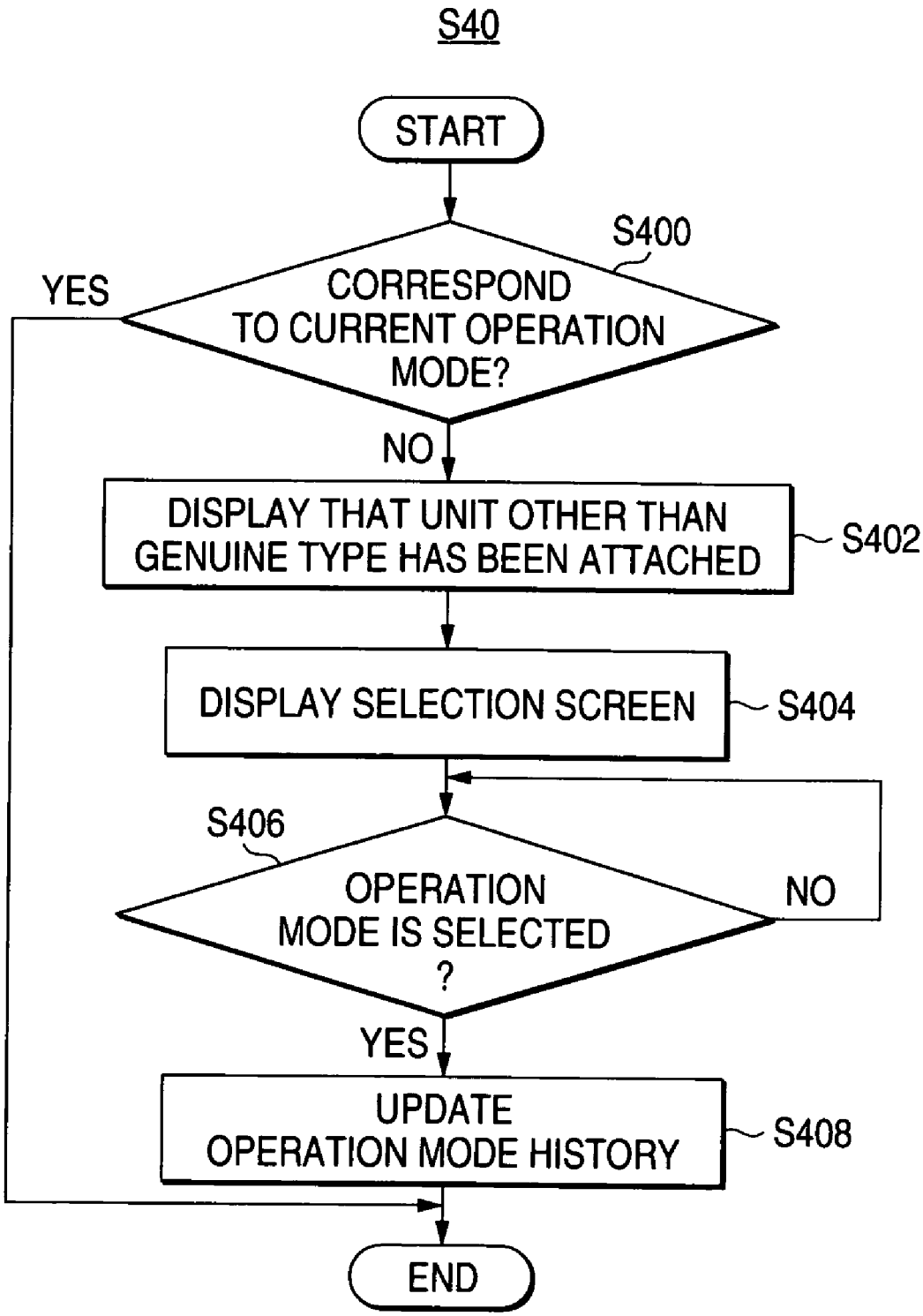
FIG. 25 is a flowchart (S40) showing the operation mode shifting processing for a unit other than a genuine type performed by the image forming device.

FIG. 25 is a flowchart (S40) showing the operation mode shifting processing for a unit other than the genuine type performed by the image forming device 10.

As shown in FIG. 22, in step 1100 (S1100), the CPU 202 determines whether or not an input for starting the setting of the determining time for determining whether the toner cartridge is the genuine type or one other than the genuine type has been inputted through the UI device 18 etc. When the input for starting the setting of the determining time has been inputted, the CPU 202 proceeds the process to step S1020. When there has not been such an input, the CPU waits until the input for starting the setting of the determining time is inputted.

Figure 26A:
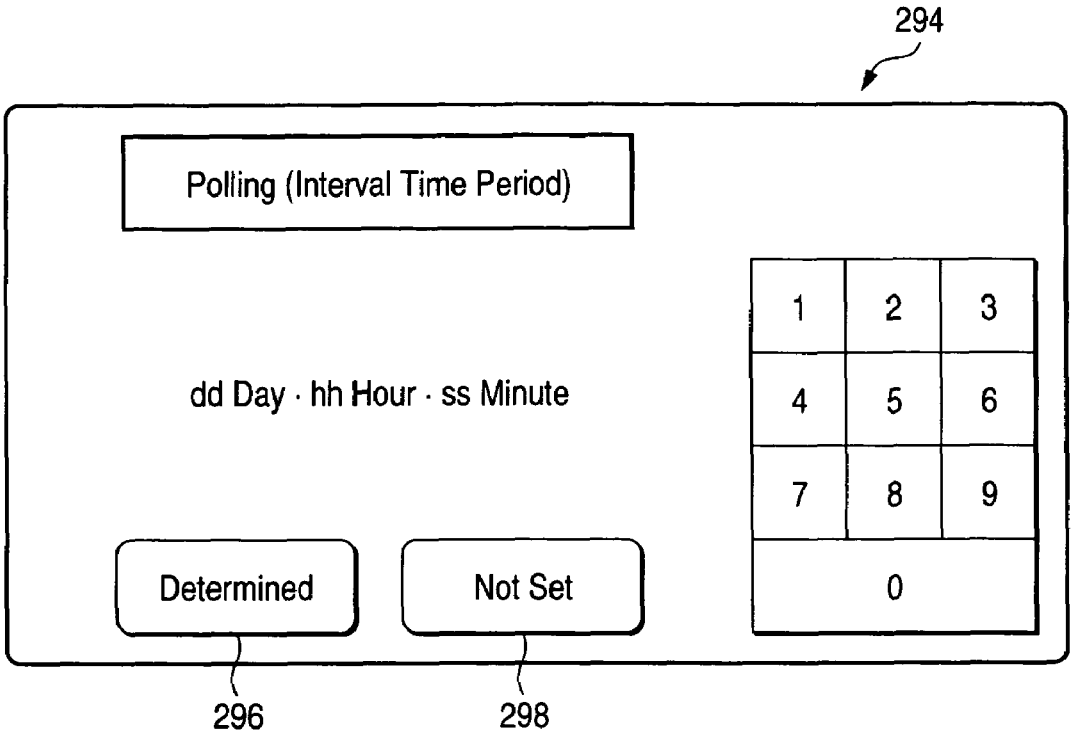

In step 1200 (S1200 of FIG. 23), the UI device 18 displays a setting input screen 294 for polling (interval time period) shown in FIG. 26A. The setting input screen 294 for the polling is arranged so that a user can set and input the polling in which the toner cartridge 52 and the radio communication portion 56 start at a predetermined time interval the communication for determining whether the toner cartridge 52 having been attached is the genuine type or not. This setting input screen has a key button 296 for receiving a user's determined input and a key button 298 for receiving an input representing that the polling is not set.

In step 1202 (S1202), the CPU 202 determines whether or not the polling is set and input via the UI device 18. When it is determined that the polling is set and input, the process proceeds to the processing of step 204, whilst when it is determined that the polling is not set nor input, the process proceeds to the processing of step 206.

In step 1204 (S1204), the CPU 202 stores the setting of the polling inputted via the UI device 18 as the setting value 271 of the NVM 228.

Figure 26B:
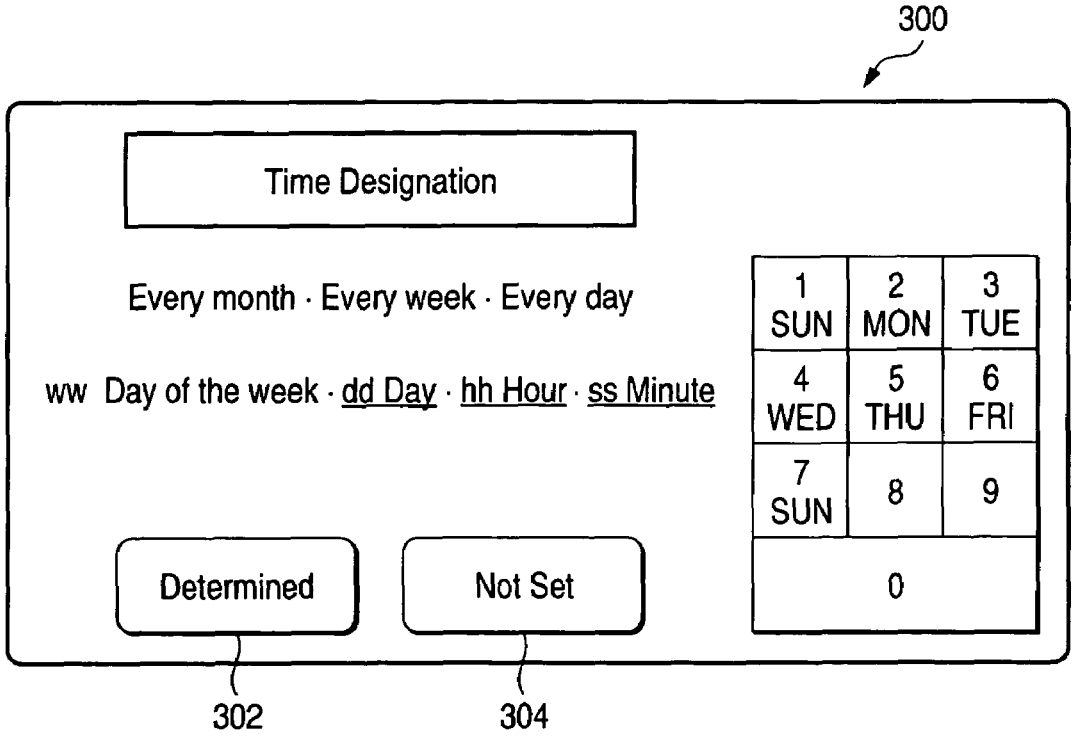

In step 1206 (S1206), the UI device 18 displays a setting input screen 300 for designating the time of the communication shown in FIG. 26B. The setting input screen 300 is arranged so that a user can set and input the time (including the repeating operation started at the same time) at which the toner cartridge 52 and the radio communication portion 56 start the communication for determining whether the toner cartridge 52 having been attached is the genuine type or not. This setting input screen has a key button 302 for receiving a user's determined input and a key button 304 for receiving an input representing that the time is not set.

In step 1208 (S1208), the CPU 202 determines whether or not the time is set and input via the UI device 18. When it is determined that the time is set and input, the process proceeds to the processing of step 210, whilst when it is determined that the time is not set nor input, the process is terminated In step 1210 (S1210), the CPU 202 stores the set time inputted via the UI device 18 as the setting value 271 of the NVM 228.

In step 1102 (S1102 of FIG. 22), the CPU 202 determines whether or not it is the time for starting the determination (time for starting the communication) as to whether the toner cartridge 52 having been attached is the genuine type or not with reference to the setting of the polling and the time stored as the setting values 271. When it is determined that it is the time for starting the determination as to whether the toner cartridge having been attached is the genuine type or not, the CPU 202 proceeds the process to step 104, whilst when it is determined that it is not the time for determining, the CPU waits for the determining time.

In step 1104 (S1104), the CPU 202 determines whether or not it is possible to communicate between the radio communication portion 56 and the toner cartridge 52 in accordance with the fact whether or not the radio communication portion 56 has received the acknowledge signal sent from the memory chip 170 of the toner cartridge 52. When it is determined that it is possible to communicate between the radio communication portion 56 and the toner cartridge 52, the CPU 202 proceeds the process to step 106. In contrast, when it is determined that it is not possible to communicate, the CPU 202 determines that the toner cartridge 52 is a toner cartridge other than the genuine type and proceeds the process to step 40.

In step 1106 (S1106), the CPU 202 reads the machine type code 276 and the nation code 278 from the unit NVM 184.

In step 1108 (S1108), the CPU 202 reads the corresponding machine type code 258 and the corresponding nation code 260 from the main body NVM 228.

In step 1110 (S110), the CPU 202 collates the machine type code 276 with the corresponding machine type code 258 and also collates the nation code 278 with the corresponding nation code 260. As the result of the collations, when it is determined that the toner cartridge 52 having been exchanged is not the genuine type (that is, a toner cartridge other than the genuine type), the process proceeds to step 40.

In step 1300 (S1300 of FIG. 24), the CPU 202 determines whether or not the current operation mode stored in the operation mode histories 270 corresponds to the toner cartridge 52. When it is determined that the current operation mode does not correspond to the toner cartridge, the process proceeds to step 302, whilst when it is determined that the current operation mode corresponds to the toner cartridge, the process is terminated.

In step 1302 (S1302), the UI device 18 displays that the toner cartridge 52 of the genuine type has been attached.

Figure 27:
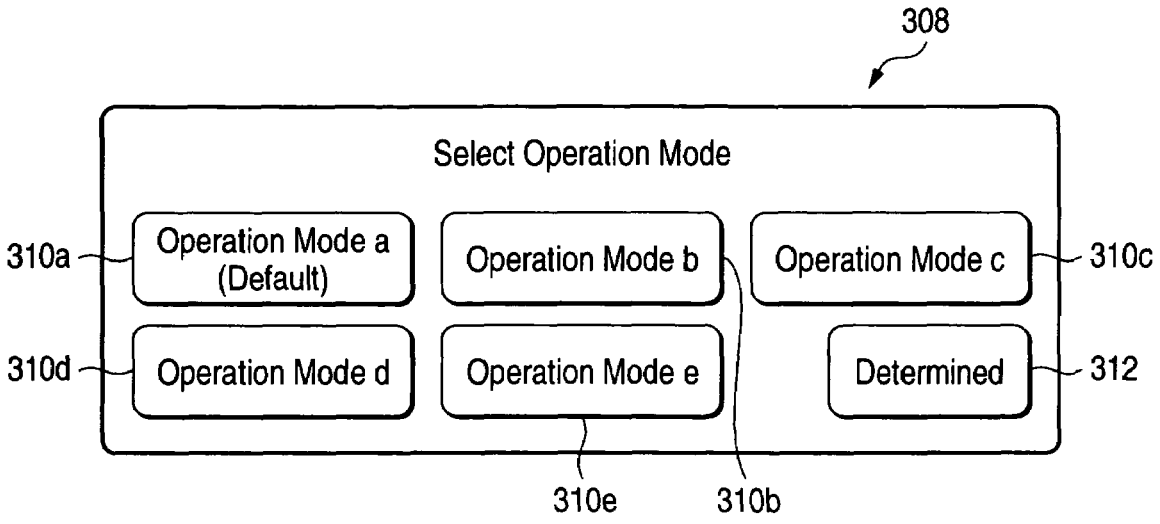
FIG. 27 is a diagram showing a selection screen for the operation mode displayed on the UI device.

In step 1304 (S1304), the UI device 18 displays a selection screen 308 for the operation mode shown in FIG. 27. The selection screen 308 has key buttons 310*a* to 310*e* for selecting the operation mode, for example, and a key button 312 for receiving an input representing the determination of the setting of the operation mode corresponding to one of the key buttons 310*a* to 310*e* displayed in a highlight manner. In the selection screen 308, the operation mode a which is the operation mode corresponding to the toner cartridge 52 of the genuine type is highlighted as the default, for example.

The steps 1302 and 1304 may be executed simultaneously by the UI device 18.

In step 1306 (S1306), the CPU 202 determines whether or not the inputting operation for selecting the operation mode via the UI device 18 is completed. When it is determined that the inputting operation is completed, the process proceeds to step 308, whilst when it is determined that the inputting operation is not completed yet, the CPU waits for a user's inputting operation for selecting the operation mode.

In step 1308 (S1308), the CPU 202 updates (including the overwriting by the same operation mode) the operation mode histories 270 of the main body NVM 228 by the operation mode selected by the step 306.

In step 400 (S400 of FIG. 25), the CPU 202 determines whether or not the current operation mode stored in the operation mode histories 270 corresponds to the toner cartridge 52. When it is determined that the current operation mode does not correspond to the toner cartridge, the process proceeds to step 402, whilst when it is determined that the current operation mode corresponds to the toner cartridge, the process is terminated.

In step 402 (S402), the UI device 18 displays that the toner cartridge 52 other than the genuine type has been attached.

In step 404 (S404), the UI device 18 displays the selection screen 308 for the operation mode shown in FIG. 27.

The steps 402 and 404 may be executed simultaneously by the UI device 18.

In step 406 (S406), the CPU 202 determines whether or not the inputting operation for selecting the operation mode via the UI device 18 is completed. When it is determined that the inputting operation is completed, the process proceeds to step 408, whilst when it is determined that the inputting operation is not completed yet, the CPU waits for a user's inputting operation for selecting the operation mode.

In step 408 (S408), the CPU 202 updates (including the overwriting by the same operation mode) the operation mode histories 270 of the main body NVM 228 by the operation mode selected by the step 406.

In step 1112 (S1112 of FIG. 22), the CPU 202 performs the printing operation preparing processing according to the operation mode contained in the newest operation mode histories 270.

In step 1114 (S1114), the CPU 202 determines with reference to the setting values 271 whether or not there is any determining time having not been executed yet. When it is determined that there is a determining time having not been executed yet, the process proceeds to step 102, whilst when it is determined that there is no determining time having not been executed yet, the process is terminated.

Next, the explanation will be made as to a modified example of the printing operation preparing processing (S1010) for the toner cartridge 52 performed by the image forming device 10 in accordance with the operation mode.

Figure 28:
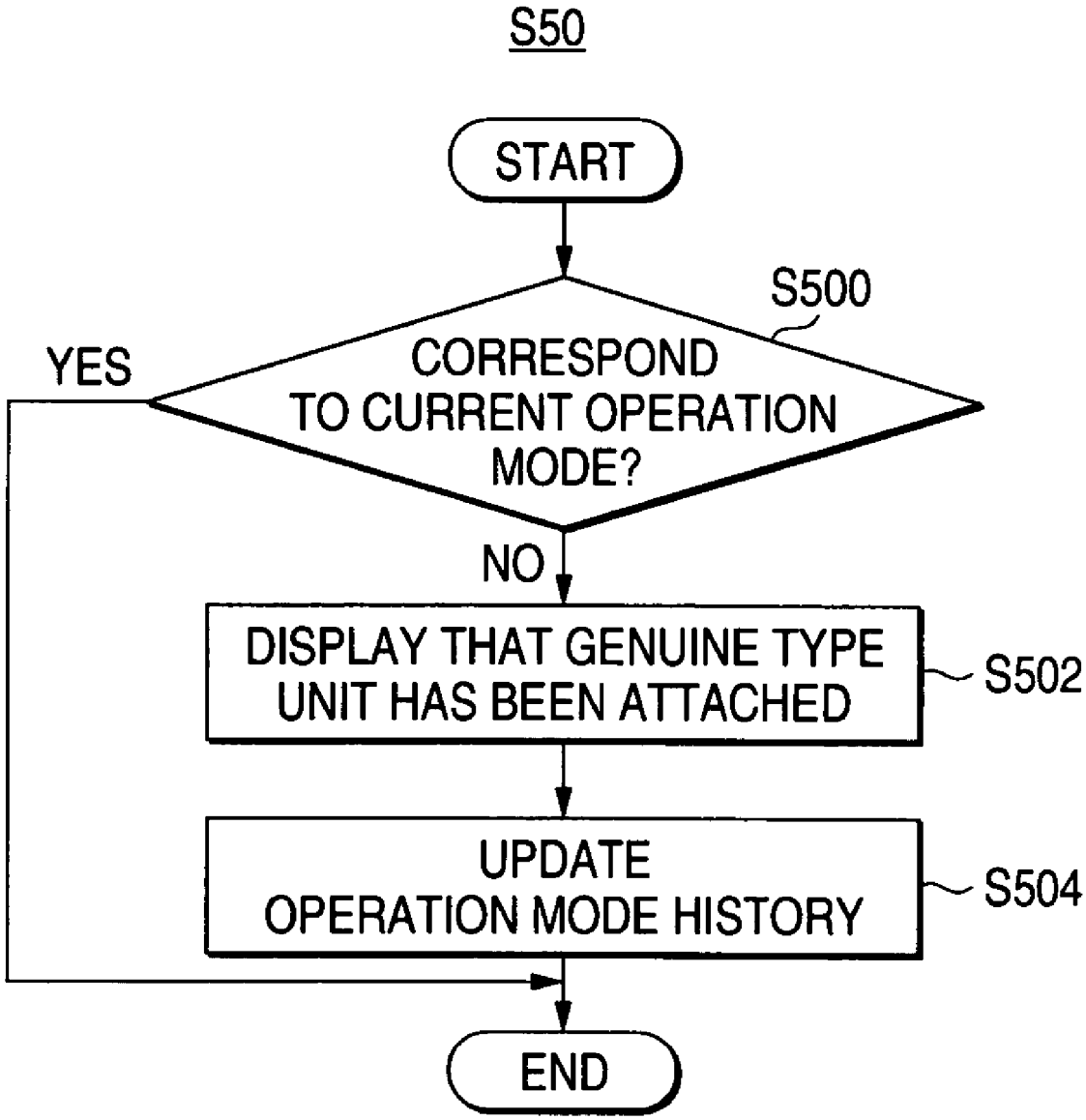
FIG. 28 is a flowchart (S50) showing a modified example of the printing operation preparing processing for a genuine type unit.
Figure 29:
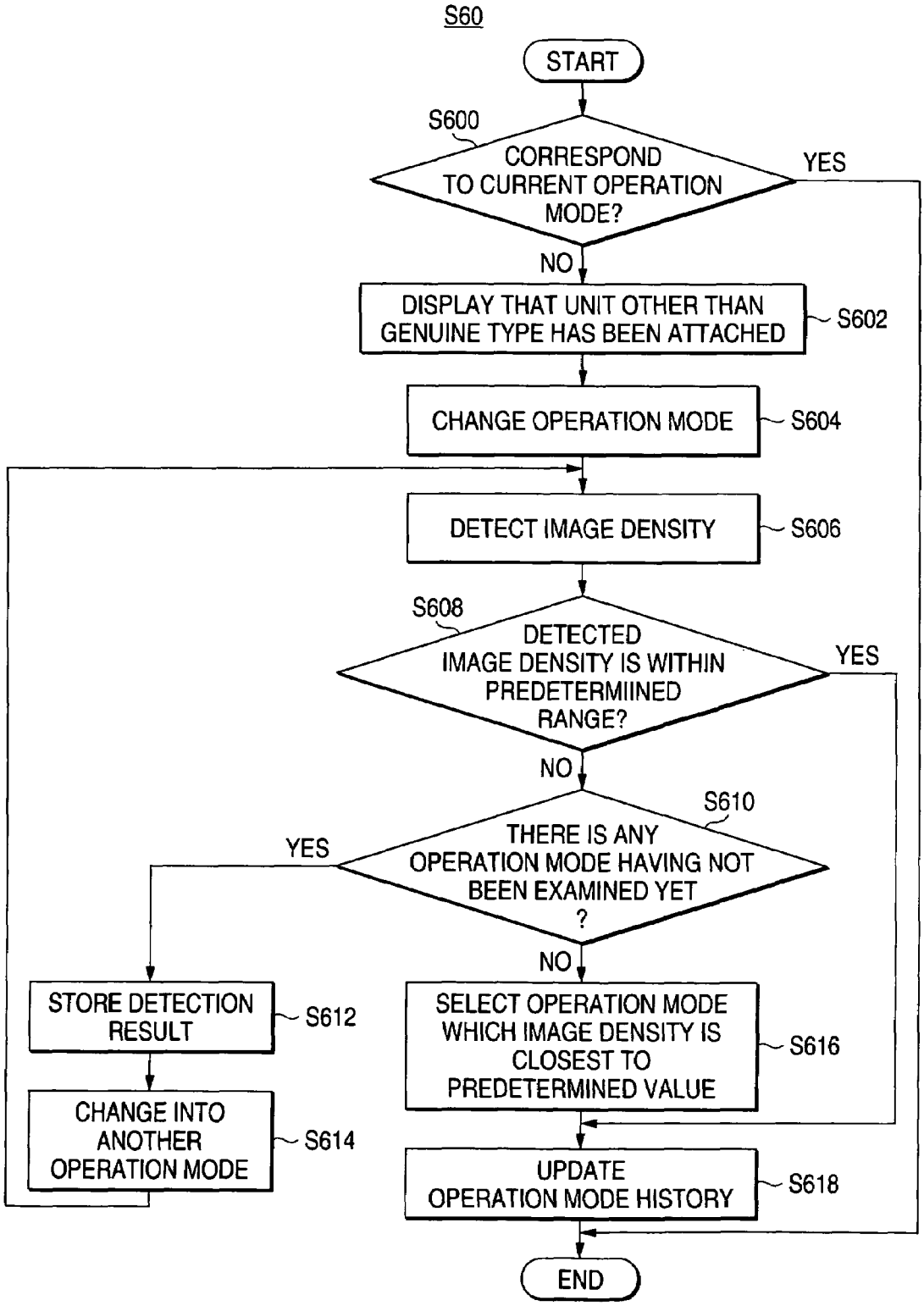
FIG. 29 is a flowchart (S60) showing a modified example of the printing operation preparing processing for a unit other than the genuine type.

In the printing operation preparing processing (S1010) performed by the image forming device 10 in accordance with the operation mode, the operation mode shifting processing (S1030) for the genuine type unit may be replaced by a modified example of the printing operation preparing processing (S50) for the genuine type unit shown in FIG. 28, and also the operation mode shifting processing (S40) for a unit other than the genuine type may be replaced by a modified example of the printing operation preparing processing (S60) for a unit other than the genuine type shown in FIG. 29.

As shown in FIG. 28, in step 500 (S500), the CPU 202 determines whether or not the current operation mode stored in the operation mode histories 270 corresponds to the toner cartridge 52. When it is determined that the current operation mode does not correspond to the toner cartridge, the process proceeds to step 502, whilst when it is determined that the current operation mode corresponds to the toner cartridge, the process is terminated.

In step 502 (S502), the UI device 18 displays that the toner cartridge 52 of the genuine type has been attached.

In step 504 (S504), the CPU 202 updates the operation mode histories 270 of the main body NVM 228 by the operation mode corresponding to the genuine type unit.

As shown in FIG. 29, in step 600 (S600), the CPU 202 determines whether or not the current operation mode stored in the operation mode histories 270 corresponds to the toner cartridge 52. When it is determined that the current operation mode does not correspond to the toner cartridge, the process proceeds to step 602, whilst when it is determined that the current operation mode corresponds to the toner cartridge, the process is terminated.

In step 602 (S602), the UI device 18 displays that the toner cartridge 52 other than the genuine type has been attached.

In step 604 (S604), the CPU 202 changes the current operation mode into one of the operation modes other than the operation mode corresponding to the toner cartridge 52 of the genuine type which is stored in the program ROM 224, for example.

In step 606 (S606), the CPU 202 forms a patch at the intermediate transfer member 74 to detect the image density in the changed operation mode.

In step 608 (S608), the CPU 202 determines whether or not the image density detected in the step 606 is within a predetermined range. When it is determined that the image density is within the predetermined range, the process proceeds to step 618, whilst when it is determined that the image density is not within the predetermined range, the process proceeds to step 610.

In step 610 (S610), the CPU 202 determines with reference to the program ROM 224, for example, whether or not there is any operation mode having not been examined yet as to the image density. When it is determined that there is an operation mode having not been examined yet, the process proceeds to step 612, whilst when it is determined that there is no operation mode having not been examined yet, the process proceeds to step 616.

In step 612 (S612), the CPU 202 stores the detection result of the image density detected in step 606 into the RAM 226 together with the operation mode.

In step 614 (S614), the CPU 202 changes the current operation mode into one of the operation modes having not been examined yet As to the image density and proceeds the process to step 606.

In step 616 (S616), the CPU 202 selects the operation mode which image density is closest to the predetermined value based on the detection result of the image density stored in the RAM 226.

In step 618 (S618), the CPU 202 updates the operation mode histories 270 of the main body NVM 228 by the operation mode which image density is determined to be within the predetermined range by the processing of step 608 or the operation mode selected by the processing of step 616.

In this manner, according to the modified example in which the image forming device 10 performs the printing operation preparing processing matching to the operation mode, even when a user does not select the operation mode, the operation mode corresponding to a replacement unit of the genuine type is set when a replacement unit of the genuine type is attached. In contrast, the operation mode other than the operation mode corresponding to a replacement unit of the genuine type is set when a replacement unit other than the genuine type is attached. In this respect, even when anyone of the aforesaid operation modes is set, a user can confirm through the display as to which one of a replacement unit of the genuine type and a replacement unit other than the genuine type is attached.

What is claimed is:

1. An image forming device comprising:

a device main body comprising a first storage unit;

a replacement unit attached to the device main body in an exchangeable manner, wherein the replacement unit comprises a second storage unit different from the first storage unit, and the first storage unit stores a status of the replacement unit as to whether the replacement unit is a genuine type or one other than the genuine type when a power supply for the device main body is turned off;

a discriminating unit for discriminating at a time of turning-on of the power supply whether the replacement unit is the genuine type or one other than the genuine type; and a comparison unit for comparing storage content of the first storage unit of the device main body with discrimination result of the discriminating unit.

2. The image forming device according to claim 1, further comprising:

a display unit for displaying the status of the replacement unit according to comparison result of the comparison unit.

3. The image forming device according to claim 1, further comprising:

a control unit for performing a control in accordance with an operation mode according to the comparison result of the comparison unit.

4. An image forming device comprising:

a device main body;

a replacement unit attached to the device main body in an exchangeable manner;

a discriminating unit for discriminating at a time of turning-on of a power supply for the device main body whether the replacement unit is a genuine type or one other than the genuine type;

an input unit for allowing a user to select one of (i) a first operation mode corresponding to the replacement unit of the genuine type and (ii) another operation mode different from the first operation mode;

a storage unit for storing a status of the replacement unit upon turning-off of the power supply as to whether the replacement unit is the genuine type or one other than the genuine type;

a comparison unit for comparing storage content of the storage unit with discrimination result of the discriminating unit; and a control unit for performing a control in accordance with the operation mode selected by the input unit.

5. The image forming device according to claim 4, further comprising a display unit for displaying the status of the replacement unit according to comparison result of the comparison unit.

6. An image forming device comprising:

a device main body;

a replacement unit attached to the device main body in an exchangeable manner;

a reading unit for reading information relating to the replacement unit from the replacement unit;

a discriminating unit for discriminating whether the replacement unit is a genuine type or one other than the genuine type in accordance with the information read from the reading unit;

an input unit for allowing a user to select (i) a first operation mode corresponding to the replacement unit of the genuine type and (ii) another operation mode different from the first operation mode, the input unit allowing the selection of at least one other operation mode even when the replacement unit is a genuine type; and a control unit for performing a control in accordance with the operation mode selected by the input unit.

7. The image forming device according to claim 6, wherein the reading unit reads the information relating to the replacement unit in accordance with at least one of a predetermined time period and a predetermined time.

8. The image forming device according to claim 6, wherein the reading unit includes a setting unit for setting at least one of the predetermined time period and the predetermined time each for reading the information relating to the replacement unit, and the reading unit reads the information relating to the replacement unit in accordance with at least one of the predetermined time period and the predetermined time set by the setting unit.

9. The image forming device according to claim 6, further comprising:

a display unit for displaying in accordance with the discrimination result of the discriminating unit.

10. The image forming device according to claim 1, wherein of the replacement unit includes a reflection member, and the device main body includes an unuse detection sensor for detecting whether the replacement unit is in an unuse state by detecting a state of the reflection member.

11. The image forming device according to claim 1, further comprising:

an input unit for selecting one of (i) a first operation mode corresponding to the replacement unit of the genuine type and (ii) another operation mode different from the first operation mode; and a control unit for performing a control in accordance with the operation mode selected by the input unit.

* * * * *